US010737484B2

(12) United States Patent
Yamamoto et al.

(10) Patent No.: US 10,737,484 B2
(45) Date of Patent: Aug. 11, 2020

(54) SCREEN PRINTING APPARATUS AND SCREEN PRINTING METHOD

(71) Applicant: Panasonic Intellectual Property Management Co., Ltd., Osaka (JP)

(72) Inventors: Takahiro Yamamoto, Fukuoka (JP); Masayuki Mantani, Saga (JP); Minoru Murakami, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 146 days.

(21) Appl. No.: 15/866,841

(22) Filed: Jan. 10, 2018

(65) Prior Publication Data

US 2018/0215137 A1 Aug. 2, 2018

(30) Foreign Application Priority Data

Jan. 30, 2017 (JP) ..... 2017-013888

(51) Int. Cl.

| | |
|---|---|
| ***B41F 15/08*** | (2006.01) |
| ***B41F 15/18*** | (2006.01) |
| ***B41F 15/36*** | (2006.01) |
| ***B41F 15/34*** | (2006.01) |
| ***B41F 15/46*** | (2006.01) |

(52) U.S. Cl.

CPC ..... *B41F 15/0818* (2013.01); *B41F 15/0881* (2013.01); *B41F 15/34* (2013.01); *B41F 15/36* (2013.01); *B41F 15/46* (2013.01)

(58) Field of Classification Search

CPC .. B41F 15/0818; B41F 15/0881; B41F 15/34; B41F 15/36; B41F 15/46; B41F 15/085; B41F 15/16; B41F 15/26; B41F 15/40; B41F 15/44; H05K 3/1216; H05K 3/1225; H05K 3/1233; B41M 1/12

See application file for complete search history.

(56) References Cited

U.S. PATENT DOCUMENTS

| | | | | |
|---|---|---|---|---|
| 2007/0059087 A1* | 3/2007 | Kawabe | ..... | B41J 11/0095 400/693 |
| 2011/0192296 A1 | 8/2011 | Kim | | |
| 2018/0162118 A1* | 6/2018 | Hirukawa | ..... | B41F 15/08 |

FOREIGN PATENT DOCUMENTS

| | | | | |
|---|---|---|---|---|
| JP | 2861332 B2 | | 2/1999 | |
| JP | 2010082919 | * | 4/2010 | ..... B41F 15/36 |
| JP | 2014-107365 | * | 6/2014 | ..... H05K 3/34 |

* cited by examiner

*Primary Examiner* — Leslie J Evanisko
*Assistant Examiner* — Marissa Ferguson-Samreth
(74) *Attorney, Agent, or Firm* — Pearne & Gordon LLP

(57) ABSTRACT

A screen printing apparatus includes: a mask guide; a mask moving mechanism; and a squeegeeing mechanism. The mask guide is provided with a mask standby position, a printing-job performing position, and a mask shelter position in this order from a first end to a second end of the mask guide. The mask moving mechanism moves the used mask positioned at the printing-job performing position to the mask shelter position such that it is possible to pick up the used mask from the second end of the mask guide.

17 Claims, 19 Drawing Sheets

SCREEN PRINTING APPARATUS AND SCREEN PRINTING METHOD

BACKGROUND

1. Technical Field

The present disclosure relates to a screen printing apparatus and a screen printing method in which a mask and a board come into contact with each other and a squeegee is caused to slide on the mask such that paste is applied on the board.

2. Description of the Related Art

A screen printing apparatus has a configuration in which a mask provided with pattern openings is caused to come into contact with a board and a squeegee is caused to slide on the mask such that paste is applied to the board. The mask is manufactured in accordance with the board, and thus it is necessary to replace the mask when the board as a printing target is changed. In general, the mask is manually replaced by an operator; however, there is known a screen printing apparatus including an automatic replacement function of masks (for example, Japanese Patent No. 2861332 (PTL 1)). The screen printing apparatus including the automatic replacement function of masks is configured to include a stocker in which the masks are stocked and to automatically perform picking up of the used mask and mounting of a mask that is to be used.

SUMMARY

A screen printing apparatus includes: a mask guide; a mask moving mechanism; and a squeegeeing mechanism.

The mask guide is provided with a mask standby position, a printing-job performing position, and a mask shelter position in this order from a first end to a second end of the mask guide.

The mask moving mechanism moves a mask inserted from the first end of the mask guide and positioned at the mask standby position to the printing-job performing position.

The squeegeeing mechanism has a first squeegee, and the first squeegee slides on the mask positioned at the printing-job performing position such that paste is applied on a board under the mask.

The mask moving mechanism moves the used mask positioned at the printing-job performing position to the mask shelter position, and then it is possible to pick up the used mask from the second end of the mask guide.

A screen printing method includes: inserting a mask; moving the mask; and performing squeegeeing.

The mask guide is provided in a horizontal direction and is provided with a mask standby position, a printing-job performing position, and a mask shelter position in this order from a first end to a second end of the mask guide.

In the inserting of the mask, the mask is inserted from the first end of the mask guide and is positioned at the mask standby position.

In the moving of the mask, the mask positioned at the mask standby position is moved to the printing-job performing position.

In the performing of the squeegeeing, the first squeegee slides on the mask positioned at the printing-job performing position such that paste is applied on a board under the mask.

When the mask positioned at the mask standby position is moved to the printing-job performing position, the mask that is moved from the mask standby position to the printing-job performing position pushes the used mask positioned at the printing-job performing position such that the used mask is moved to the mask shelter position, and the used mask is picked up from the second end.

DETAILED DESCRIPTION

In the related art, a screen printing apparatus including an automatic replacement function of masks needs to have a space for installing a stocker. Further, it is necessary to include a device that picks up a used mask, a device that mounts a mask that is to be used, a device that collects the picked-up used mask, and a device that supplies the mask that is to be used. Therefore, the screen printing apparatus in the related art has a mechanism that is entirely complicated and is expensive. In addition, a moving path of the mask, which is used when the used mask is picked up, is the same as a moving path of the mask, which is used when the mask is mounted to be used from here on. Therefore, during the replacement of the masks, two stages of operations of, first, picking up the used mask from the printing-job performing position, and then mounting the mask that is to be used from here on at the printing-job performing position. As a result, it takes time to replace the masks.

Figure 1:
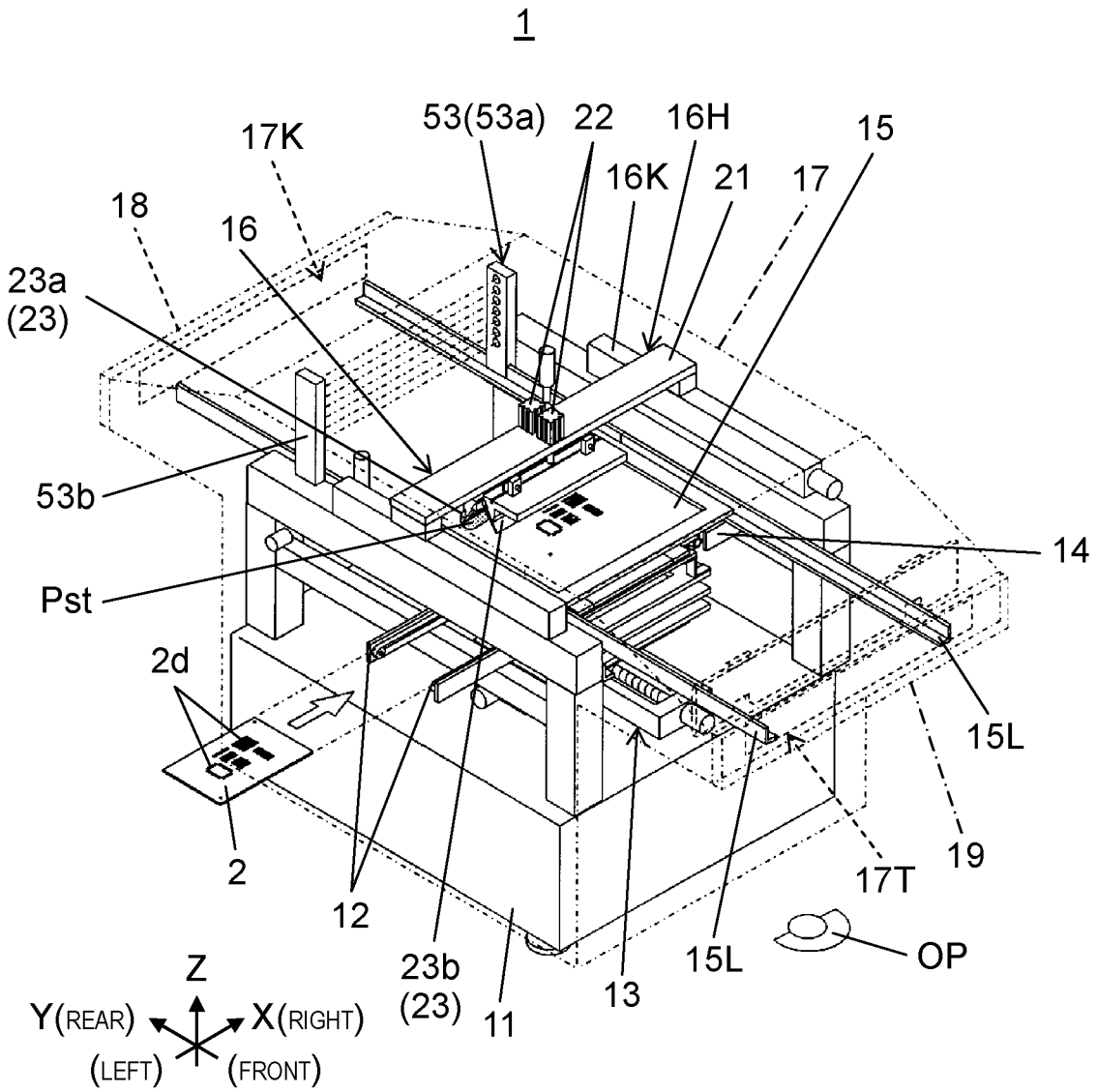
FIG. 1 is a perspective view of a screen printing apparatus in an exemplary embodiment.
Figure 2:
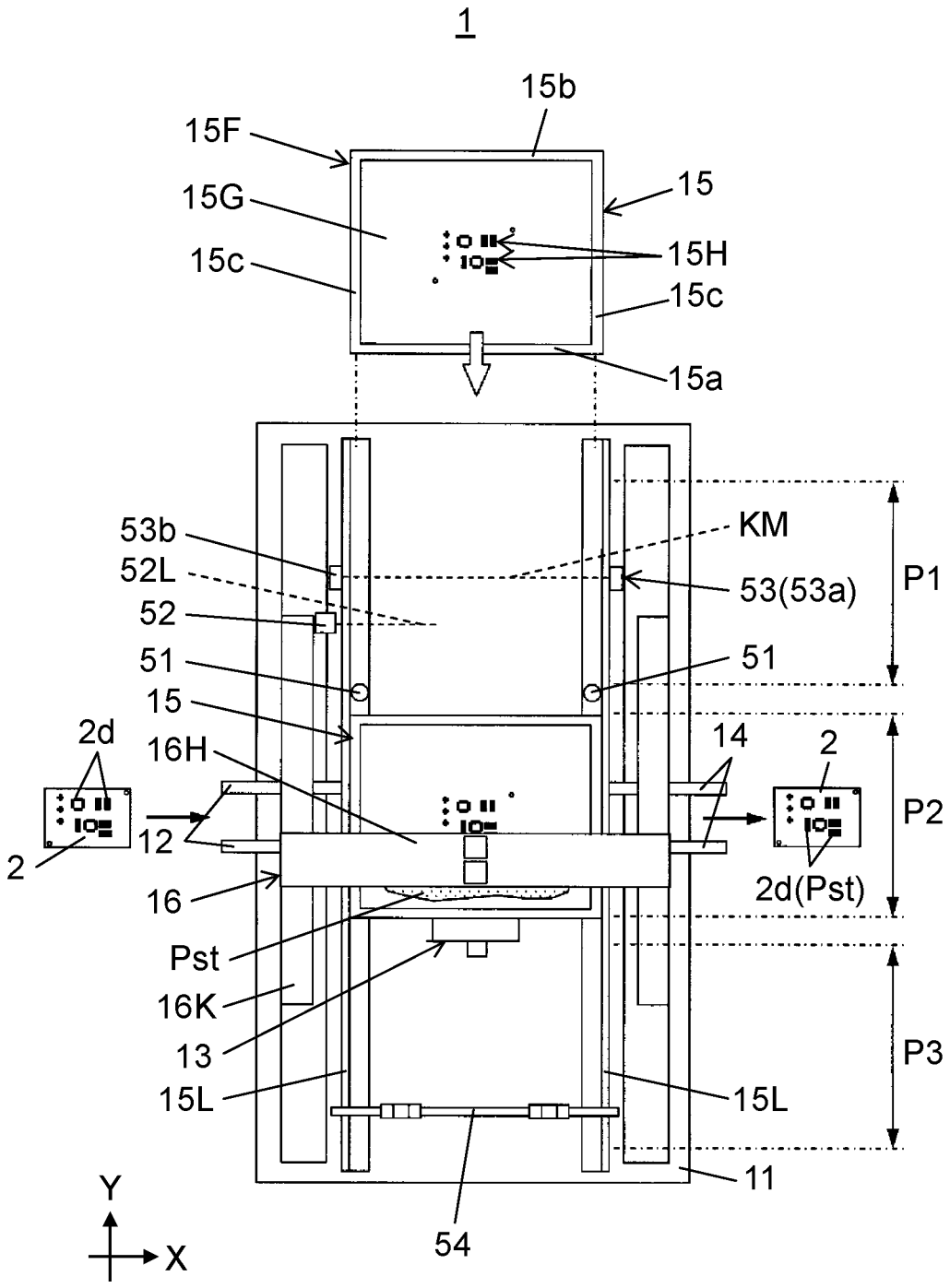
FIG. 2 is a plan view of the screen printing apparatus in the exemplary embodiment.
Figure 3:
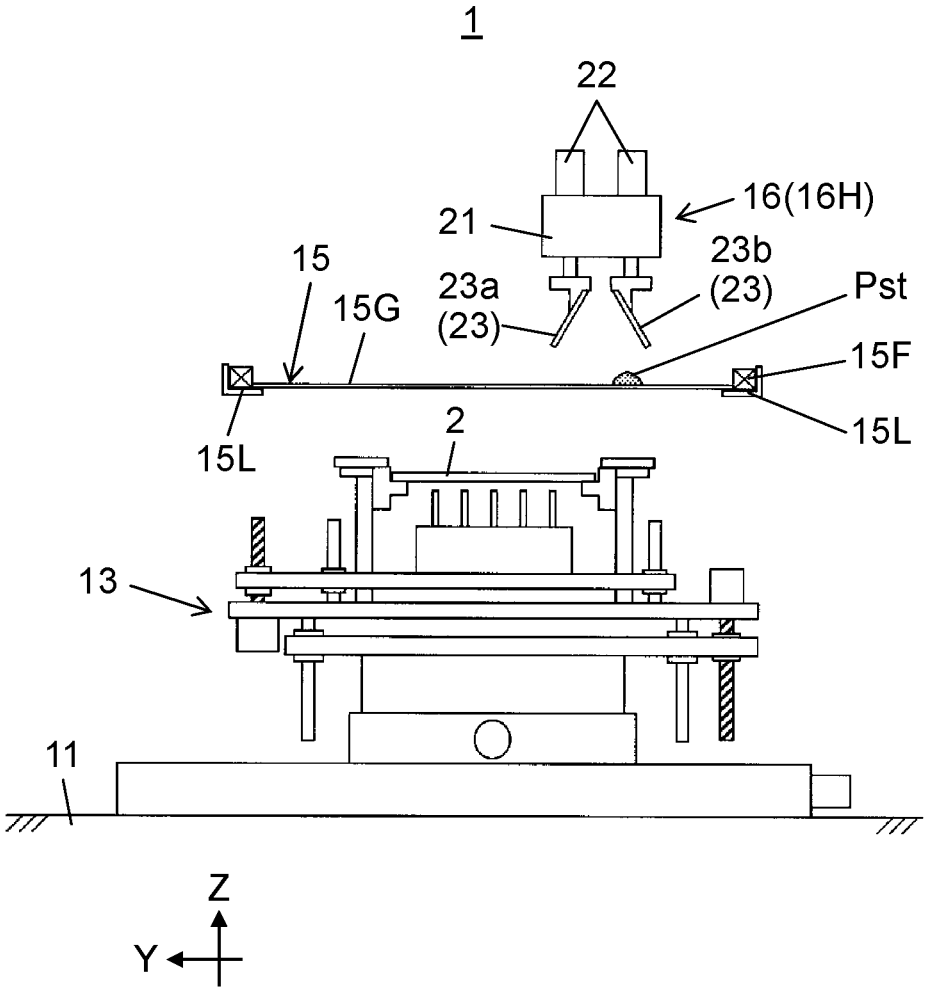
FIG. 3 is a partial side view of the screen printing apparatus in the exemplary embodiment.

Hereinafter, an exemplary embodiment of the present disclosure will be described with reference to the figures. FIGS. 1, 2, and 3 illustrate screen printing apparatus 1 in an exemplary embodiment of the present disclosure. Screen printing apparatus 1 loads board 2 supplied from a side of an upstream process, performs printing with paste Pst such as solder on electrode 2*d* provided on a surface of board 2, and unloads the board to a side of a downstream process. Here, for the convenience of description, a rightward-leftward direction of screen printing apparatus 1 viewed from operator OP is referred to as an X-axis direction, a left side is referred to as the side of the upstream process, and a right side is referred to as the side of the downstream process. In addition, a frontward-rearward direction of screen printing apparatus 1 viewed from operator OP is referred to as a Y-axis direction, a close side viewed from operator OP is referred to as a front side, and a deep side viewed from operator OP is referred to as a rear side. Further, an upward-downward direction of screen printing apparatus 1 is referred to as a Z-axis direction.

Figure 4:
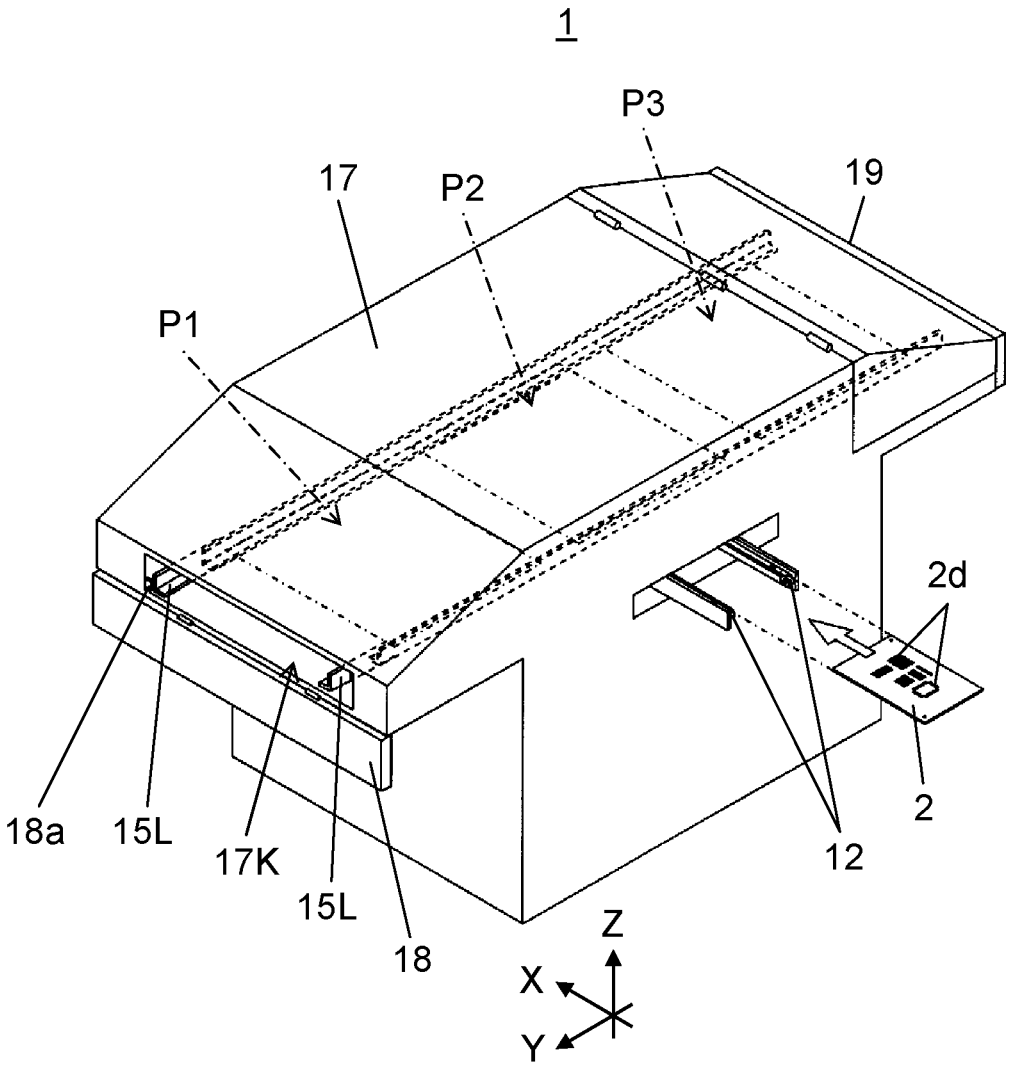
FIG. 4 is a perspective view of the screen printing apparatus in the exemplary embodiment.
Figure 5:
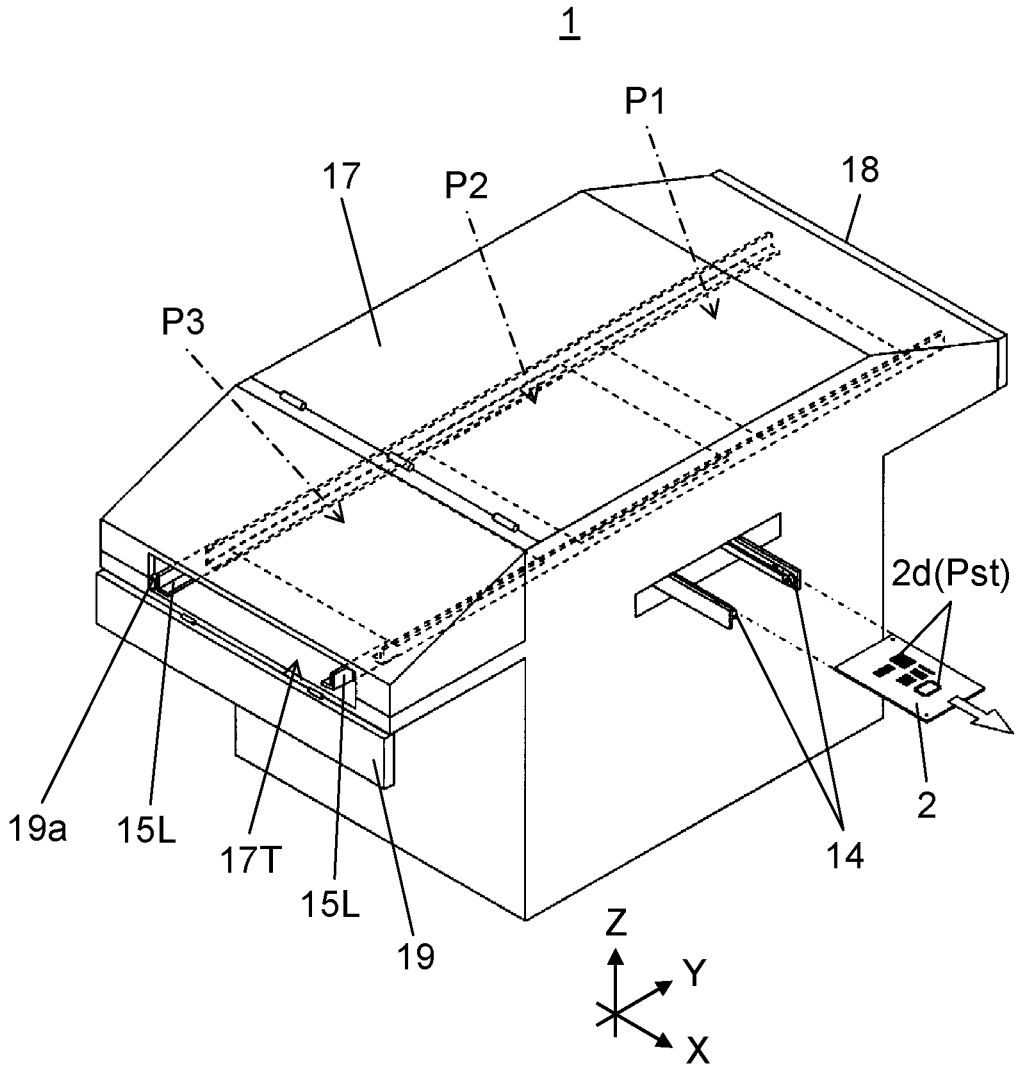
FIG. 5 is a perspective view of the screen printing apparatus in the exemplary embodiment.

In FIGS. 1, 2, and 3, screen printing apparatus 1 includes loading conveyor 12, board holding/moving mechanism 13, and unloading conveyor 14 on base stand 11. Mask 15 and squeegeeing mechanism 16 are provided above board holding/moving mechanism 13. Base stand 11 and equipment described above provided on base stand 11 are covered with cover member 17 (FIGS. 1, 4, and 5).

In FIG. 1, board holding/moving mechanism 13 is provided at the central portion of base stand 11. Board holding/moving mechanism 13 has a function of holding board 2 and a function of lifting and lowering board 2. Loading conveyor 12 loads board 2 fed from the outside and delivers the board to board holding/moving mechanism 13, and unloading conveyor 14 unloads board 2 received from board holding/moving mechanism 13.

In FIGS. 2 and 3, mask 15 is provided with mask main body 15G made of a metal plate-like member and rectangular mask frame 15F that supports the perimeter of mask main body 15G. A plurality of pattern openings 1511 disposed to correspond to electrode 2*d* of board 2 are provided at the central portion of mask main body 15G (FIG. 2).

In FIG. 2, mask frame 15F is provided with a pair of cross frames (front cross frame 15*a* and rear cross frame 15*b*) extending in the X-axis direction and a pair of perpendicular frames 15*c* extending in the Y-axis direction. Front cross frame 15*a* is positioned in front of mask main body 15G, and rear cross frame 15*b* is positioned in rear of mask main body 15G. The pair of perpendicular frames 15*c* is positioned on both sides of mask main body 15G.

In FIGS. 1 and 2, squeegeeing mechanism 16 includes print head 16H and print head moving mechanism 16K. As illustrated in FIGS. 1 and 3, print head 16H includes a moving base 21 extending in the X-axis direction and two front and rear squeegees 23 that is lifted and lowered by two squeegee lifting/lowering cylinders 22 provided on the moving base 21. Here, rear squeegee 23 is referred to as first squeegee 23*a*, and front squeegee 23 is referred to as second squeegee 23*b* (protrusion). Print head 16H is driven by print head moving mechanism 16K and moves in the Y-axis direction.

In FIGS. 1, 2, 3 and 4, each of a pair of mask guides 15L disposed right and left above the base stand 11 is provided in the Y-axis direction (that is, a horizontal direction). An interval between the pair of mask guides 15L in the X-axis direction is equal to an interval between two perpendicular frames 15*c* of mask frame 15F. The pair of mask guides 15L has a length to the extent that it is possible to mount three masks 15 in the Y-axis direction and is provided with mask standby position P1, printing-job performing position P2, and mask shelter position P3 in this order from a side of a rear end (that is, one end) (FIGS. 2, 4, and 5).

In FIGS. 1, 4 and 5, the pair of mask guides 15L is covered with cover member 17. A rear portion of cover member 17 is provided with mask inserting opening 17K that is open to a side of mask standby position P1 of mask guides 15L. Rear door 18 provided in a rear portion of cover member 17 opens and closes mask inserting opening 17K. A front portion of cover member 17 is provided with mask picking-up opening 17T that is open to a side of mask shelter position P3 of mask guides 15L. Front door 19 provided in a front portion of cover member 17 opens and closes mask picking-up opening 17T (FIGS. 1 and 2). Each of rear door 18 and front door 19 can oscillate down and open.

In the exemplary embodiment, a configuration in which mask 15 is inserted from the rear side of screen printing apparatus 1, and mask 15 is picked up from the front side of screen printing apparatus 1 is described; however, the exemplary embodiment may employ another configuration. In addition, the exemplary embodiment employs a configuration in which rear door 18 and front door 19 oscillate down and are open, but the exemplary embodiment may employ a configuration in which the doors are open up. However, from a viewpoint of maintaining a state of stable opening during insertion of the mask, it is desirable to employ the configuration in which the door is open down.

When rear door 18 oscillates down and is in an open door state (FIG. 4), operator OP can insert mask 15 through mask inserting opening 17K into a rear end portion of the pair of mask guides 15L. When operator OP mounts mask 15 at mask standby position P1, the operator mounts both ends of front cross frame 15*a* of mask 15 in a horizontal posture on the pair of mask guides 15L and pushes rear cross frame 15*b* of mask 15 to the front side (arrow P in FIG. 6).

As will be described below, squeegeeing mechanism 16 as a moving mechanism moves (disposes) mask 15 pushed to mask standby position P1 to printing-job performing position P2 at the central portion on mask guide 15L. After a printing job is finished by using mask 15, mask 15 mounted at printing-job performing position P2 is moved as used mask 15 to (sheltered at) mask shelter position P3 by squeegeeing mechanism 16 and is picked up by operator OP.

In the movement of mask 15 on mask guides 15L, a region between mask standby position P1 and printing-job performing position P2 on mask guides 15L functions as a moving path of mask 15 for mounting mask 15 at printing-job performing position P2. In addition, a region between printing-job performing position P2 and mask shelter position P3 on mask guides 15L functions as a moving path of mask 15 for picking up (sheltering) mask 15 from printing-job performing position P2.

In FIG. 4, a rear end portion of cover member 17 is provided with rear-door sensor 18*a*. Rear-door sensor 18*a* detects an open/closed state of rear door 18 with respect to mask inserting opening 17K. In FIG. 5 a front end portion of cover member 17 is provided with front-door locking mechanism 19*a*. Front-door locking mechanism 19*a* mechanically locks front door 19 into a closed door state with respect to mask picking-up opening 17T and also unlocks the front door. Here, front-door locking mechanism 19*a* is configured to mechanically lock front door 19; however, the front-door locking mechanism may not be configured to perform mechanical locking. However, in a case other than cases of preventing mask 15 from jumping out and picking up the mask, it is desirable that the mechanical locking is employed in order to prevent a hand of operator OP from entering from mask picking-up opening 17T.

Figure 6:
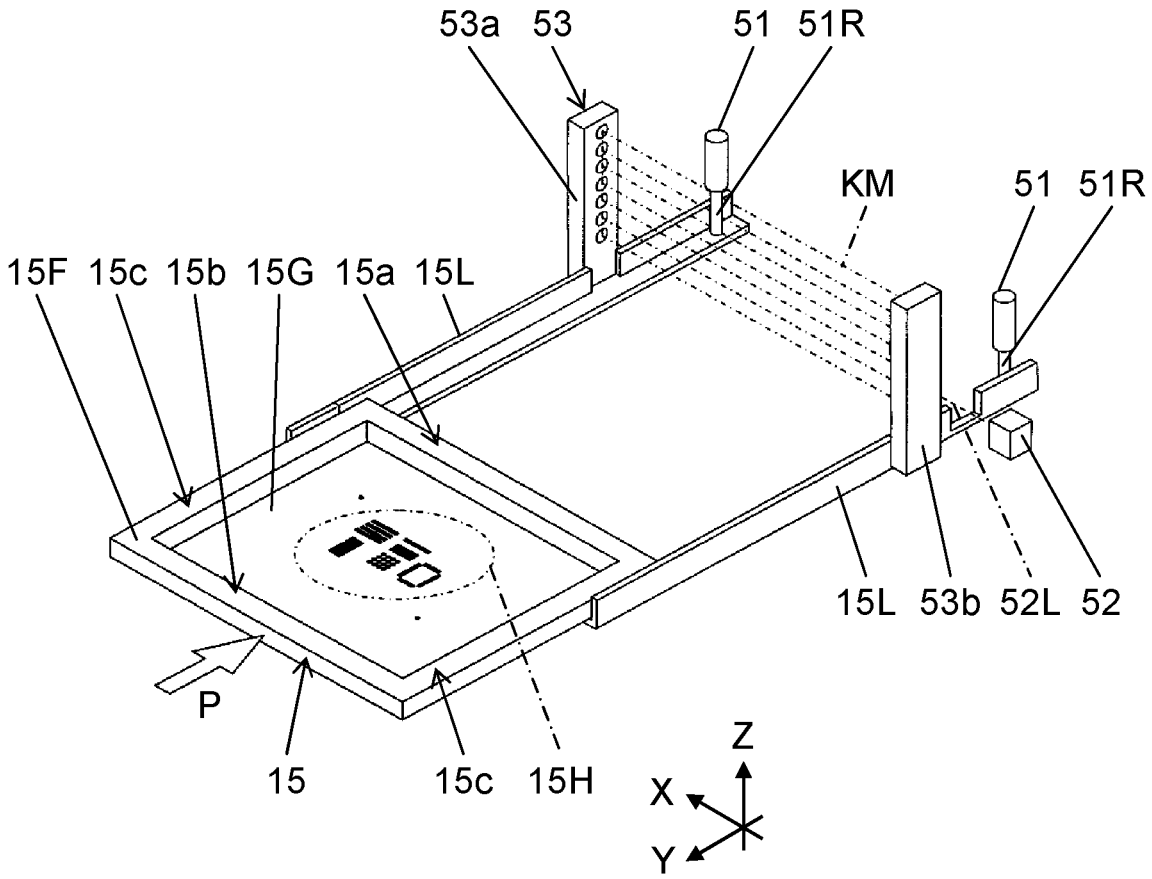
FIG. 6 is a partial perspective view of a rear part of the screen printing apparatus in the exemplary embodiment.

In FIGS. 2 and 6, a rear portion of the base stand 11 is provided with two mask stoppers 51 at upper positions of two mask guides 15L, respectively. Each of mask stoppers 51 is formed of a cylinder that actuates stopper pin 51R formed of a piston rod in the upward-downward direction. When mask 15 is inserted from mask inserting opening 17K in a state in which two mask stoppers 51 causes stopper pins 51R to project down, respectively, both ends of front cross frame 15*a* of mask frame 15F abut on two stopper pins 51R, respectively, from the rear side. In a state in which front cross frame 15*a* of mask frame 15F abuts on two stopper pins 51R, it is not possible for operator OP to push mask 15 to the front side from the state, and such a position of mask 15 corresponds to mask standby position P1. Here, mask stoppers 51 is configured to actuate stopper pins 51R in the upward-downward direction; however, stopper pin 51R may be configured to be actuated from a side of a side surface of mask 15 in a transverse direction.

In FIGS. 2 and 6, mask detecting sensor 52 is provided immediately on a rear side of mask stoppers 51. Mask detecting sensor 52 projects detection light 52L in the X-axis direction (a side to the central portion of base stand 11) and receives reflected light of detection light 52L, thereby, detecting a state in which mask frame 15F (specifically, perpendicular frames 15*c* of mask frame 15F) is positioned at a position at which detection light 52L is blocked.

In FIGS. 1, 2 and 6, inspection light curtain former 53 configured to include light projector 53*a* and light receiver 53*b* is provided at a position at which the two mask guides 15L are interposed therebetween in the X-axis direction on the rear side from two mask stoppers 51. Inspection light curtain former 53 is provided with inspection light curtain KM that is formed at a light at which the inspection light curtain does not interfere with mask 15 inserted from mask inserting opening 17K. In a case where an object (foreign object) other than mask 15 is inserted from mask inserting opening 17K, inspection light curtain KM is cut across by the foreign object. Therefore, the state in which the foreign object other than mask 15 is inserted from mask inserting opening 17K is detected.

In FIGS. 2, 7, 8A, and 8B, screen printing apparatus 1 includes oscillating body 54. Oscillating body 54 is a plate-like member extending in the X-axis direction. Oscillating body 54 is attached to a position above the pair of mask guides 15L and in the vicinity of mask picking-up opening 17T.

Figure 8A:
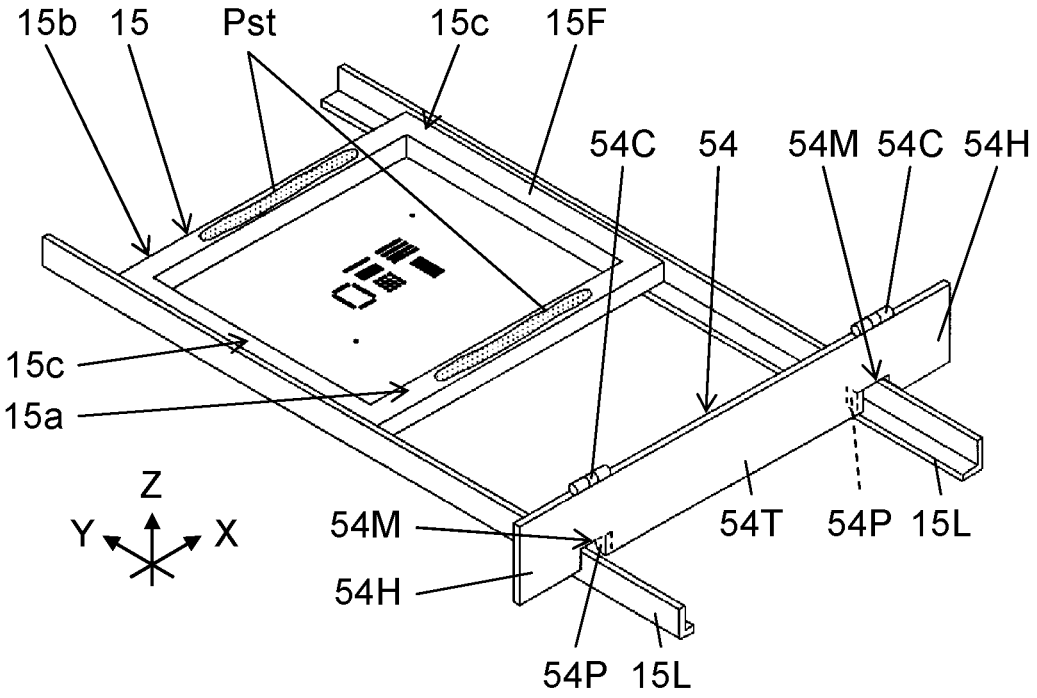
FIG. 8A is a perspective view illustrating an oscillating body with a mask and a mask guide in the exemplary embodiment.
Figure 8B:
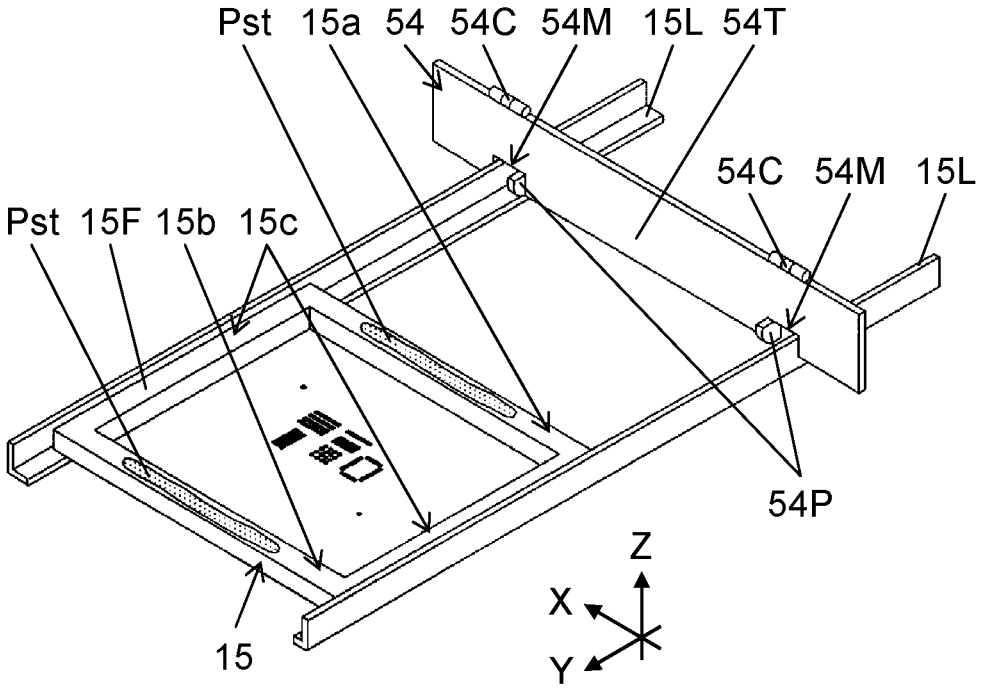
FIG. 8B is a perspective view illustrating the oscillating body with the mask and the mask guide in the exemplary embodiment.

In other words, oscillating body 54 is attached in the vicinity of a front end side (second end) of mask guides 15L. An upper edge of oscillating body 54 is attached (hinged) to a member on a side of the base stand 11 by hinge 54C having its axis in the X-axis direction. Oscillating body 54 is allowed to oscillate to the front side only (oscillate in a direction in which a lower end thereof moves onward to the front side). Then, in a state in which a pushing force to the front side is not applied, the oscillating body has a drooping-down posture in which the oscillating body droops down, due to its own weight, such that the lower end is positioned immediately below the hinge 54C (FIGS. 8A and 8B).

In FIGS. 7, 8A, 8B, 9A, and 9B, oscillating body 54 is provided with two grooves 54M, which are open downward, at two right and left positions thereof. Two grooves 54M are provided so as to avoid interference with the pair of mask guides 15L and two perpendicular frames 15*c* of mask frame 15F that moves onward on the pair of mask guides 15L.

A lower end of a portion (referred to as central portion 54T in FIGS. 7, 8A, 8B, 9A, and 9B) extending in the X-axis direction between two grooves 54M of oscillating body 54 is positioned to be higher than the top surface of mask main body 15G of mask 15 that moves onward on mask guide 15L and is positioned to be lower than the top surface of mask frame 15F (top surface of front cross frame 15*a* and rear cross frame 15*b*) when oscillating body 54 has the drooping-down posture. Therefore, when oscillating body 54 has the drooping-down posture, mask picking-up opening 17T is closed, and operator OP is restricted from inserting a hand into a region on a deeper side from oscillating body 54 (a side of the central portion of base stand 11).

Figure 9A:
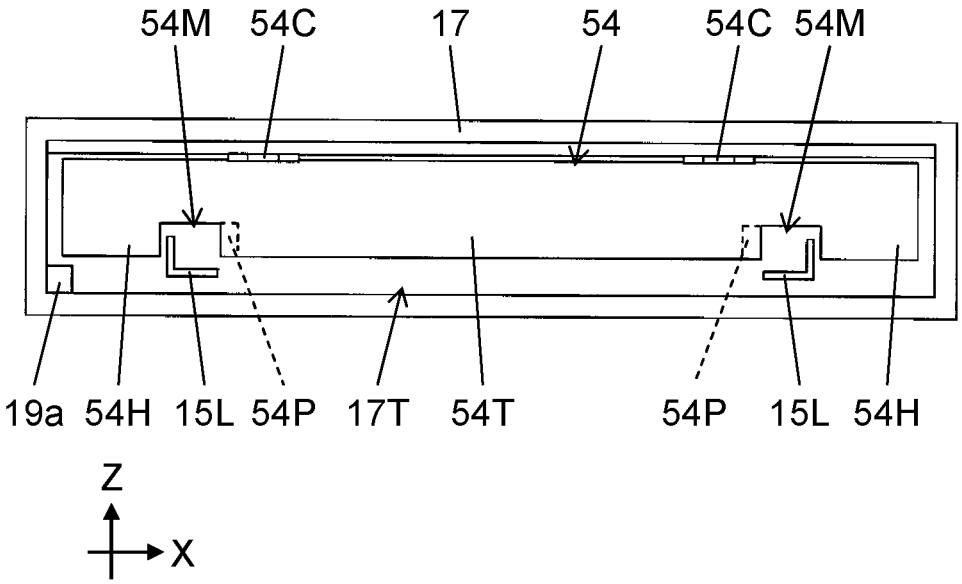
FIG. 9A is a view of a mask picking-up opening viewed from front in the exemplary embodiment.
Figure 9B:
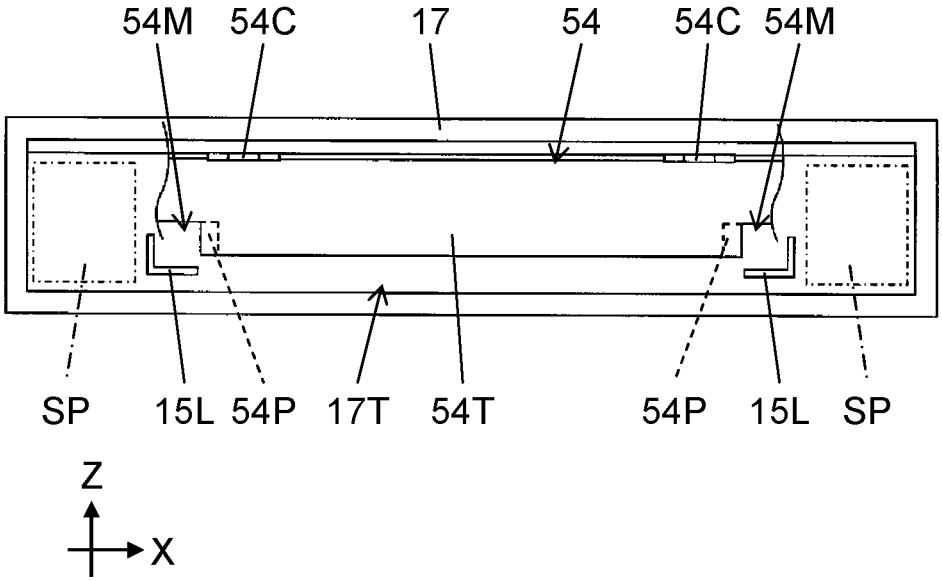
FIG. 9B is a view of the mask picking-up opening viewed from front in the exemplary embodiment.

In FIGS. 7, 8A, 8B, 9A, and 9B, oscillating body 54 is provided with two side projecting portions 5411 that project more than mask 15 that is picked up from mask picking-up opening 17T to the outer sides in the horizontal direction (X-axis direction) intersecting with an onward direction (Y-axis direction) of mask 15. As illustrated in FIG. 9A, two side projecting portions 5411 is positioned on the outer side from two grooves 54M (that is, from two mask guides 15L) in the X-axis direction. Whereas central portion 54T of oscillating body 54 is operated to block a region between two mask guides 15L, two side projecting portions 5411 is operated to block regions on the outer sides of two mask guides 15L (region SP illustrated in FIG. 9B).

Figure 10A:
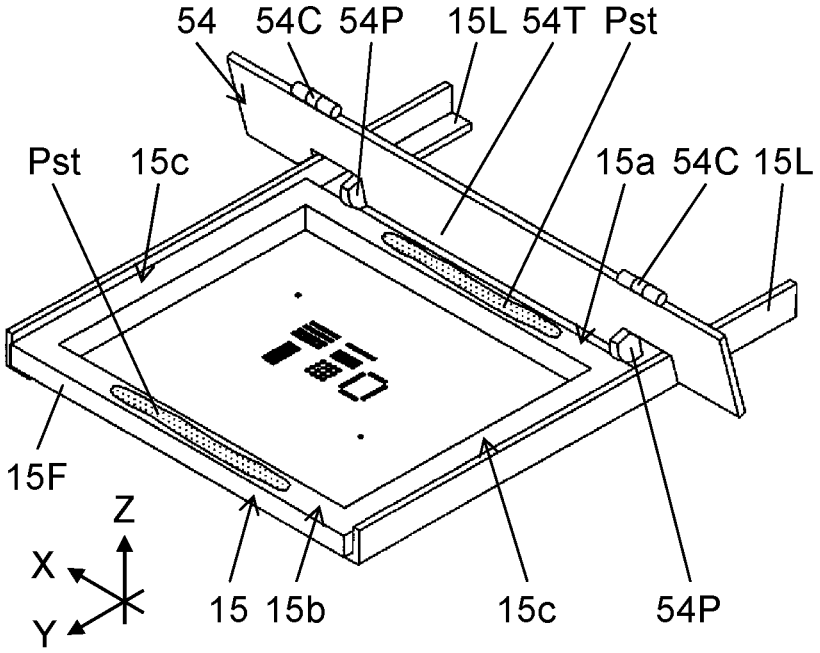
FIG. 10A is a partial perspective view illustrating an operation of the oscillating body provided in the screen printing apparatus in the exemplary embodiment.
Figure 10B:
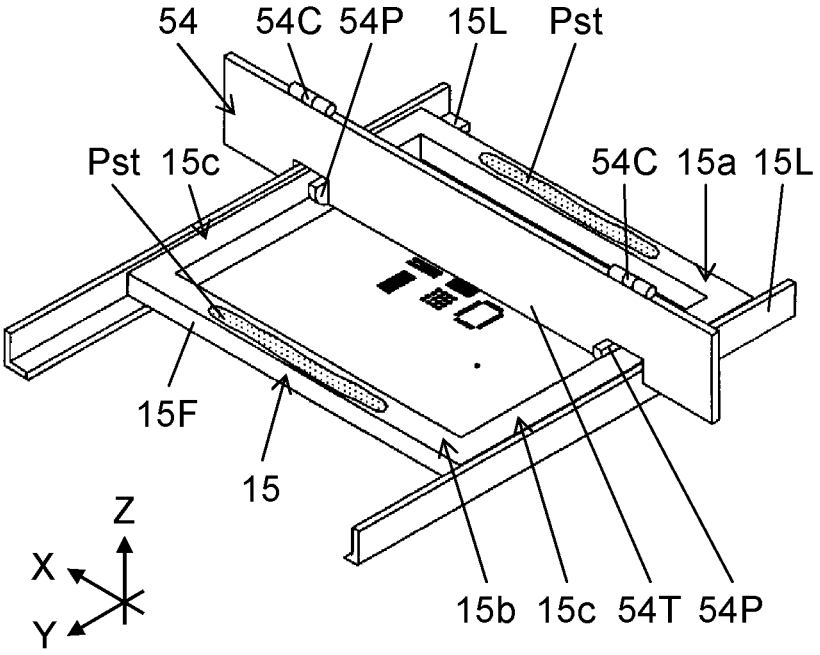
FIG. 10B is a partial perspective view illustrating the operation of the oscillating body provided in the screen printing apparatus in the exemplary embodiment.

When mask 15 at printing-job performing position P2 moves onward to mask shelter position P3 in a state in which oscillating body 54 has the drooping-down state, oscillating body 54 is pushed by a cross frame (front cross frame 15*a* or rear cross frame 15*b*) of mask frame 15F and has an oscillating posture in which the oscillating body oscillates around an axis (X axis) of hinge 54C (FIG. 10A). After the cross frames of mask frame 15F pass below oscillating body 54, oscillating body 54 is released from the pushing by mask frame 15F, and thus oscillating body 54 returns to the drooping-down posture due to its own weight (FIG. 10B).

In FIGS. 8A, 8B, 9A, 9B, 10A, and 10B, oscillating body 54 is provided with two protrusions 54P on a side of a rear surface of oscillating body 54 at a position of an end portion of central portion 54T in the X-axis direction. Two protrusions 54P extend in the upward-downward direction and are provided to protrude rearward (that is, to a side of printing-job performing position P2). When the cross frame of mask frame 15F of mask 15, which moves onward to the front side from printing-job performing position P2 (that is, toward mask shelter position P3), pushes oscillating body 54, the cross frame does not directly abut on central portion 54T of oscillating body 54, but abuts on two protrusions 54P provided at both end portions of central portion 54T in the X-axial direction. The cross frame pushes central portion 54T via two protrusions 54P. Here, the cross frame of mask frame 15F is front cross frame 15*a* or rear cross frame 15*b*, and front cross frame 15*a* pushes central portion 54T via two protrusions 54P in FIG. 10A.

Figure 11:
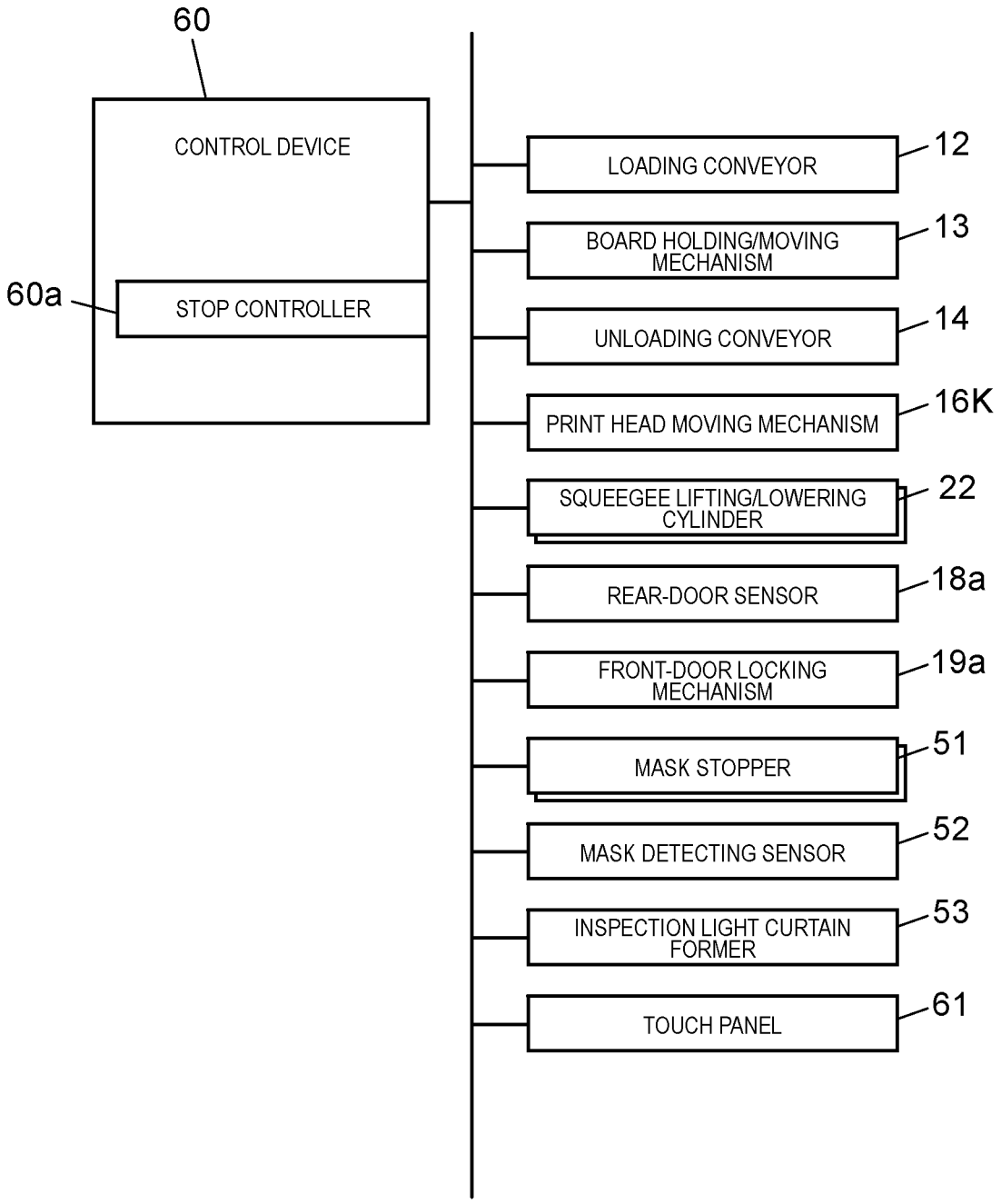
FIG. 11 is a block diagram illustrating a control system of the screen printing apparatus in the exemplary embodiment.

In FIG. 11, control device 60 provided in screen printing apparatus 1 controls a loading operation of board 2 by loading conveyor 12, a holding and moving operation of board 2 by board holding/moving mechanism 13, an unloading operation of board 2 by unloading conveyor 14, and the like. In addition, control device 60 controls a moving operation of print head 16H by print head moving mechanism 16K, a lifting/lowering operation of squeegee 23 by squeegee lifting/lowering cylinder 22, a lifting/lowering operation of stopper pin 51R of mask stoppers 51.

In FIG. 11, detection information of mask 15 by mask detecting sensor 52 is input to control device 60. Control device 60 determines that mask 15 is not positioned at mask standby position P1 in a case where mask detecting sensor 52 does not receive reflected light of inspection light. On the other hand, control device 60 determines the mask 15 is positioned at mask standby position P1 in a case where mask detecting sensor 52 receives inspection light. In addition, the control device detects a state in which mask 15 inserted from mask inserting opening 17K reaches mask standby position P1. Detection information of the open/closed state of rear door 18 by rear-door sensor 18*a* is input to control device 60, and control device 60 detects the open/closed state of rear door 18 based on the detection information transmitted from rear-door sensor 18*a*. In addition, control device 60 controls locking and unlocking of front door 19 by front-door locking mechanism 19*a*.

In FIG. 11, control device 60 includes stop controller 60*a*. Stop controller 60*a* controls stopping of an operation of a predetermined operating mechanism in a case where inspection light curtain KM formed by inspection light curtain former 53 is cut across by an inserted object (foreign object other than mask 15) inserted from mask inserting opening 17K.

Here, in a case where an object (referred to as a foreign object, for example, a hand of operator OP) other than mask 15 is inserted from mask inserting opening 17K, the "predetermined operating mechanism", specifically, means a mechanism that may be brought into contact with the foreign object of operating mechanisms positioned in a front region from the inspection light curtain KM. Specifically, in the exemplary embodiment, the predetermined operating mechanism corresponds to squeegeeing mechanism 16 and drive mechanisms related to the squeegeeing mechanism, and the printing operation is stopped.

In FIG. 11, touch panel 61 as an input/output device is connected to control device 60. Touch panel 61 functions as an input device on which operator OP performs a predetermined input to control device 60. Further, touch panel 61 functions as an output device on which control device 60 displays a state of screen printing apparatus 1 to operator OP or an operation instruction to operator OP.

Figure 12A:
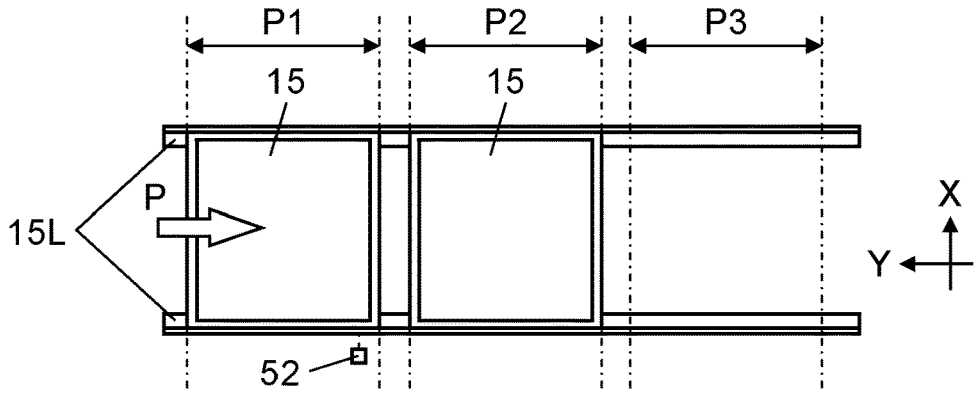
FIG. 12A is a partial plan view illustrating a procedure of mounting the mask by the screen printing apparatus in an exemplary embodiment.
Figure 13A:
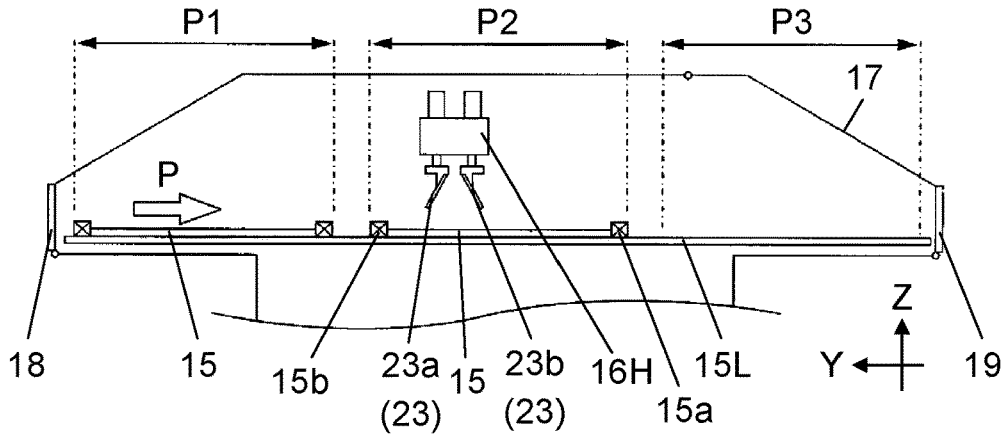
FIG. 13A is a partial side view illustrating the procedure of mounting the mask by the screen printing apparatus in the exemplary embodiment.

In order to mount mask 15 at printing-job performing position P2, first, operator OP moves the mask at a rear position of the base stand 11 from a front position of the base stand 11, and then rear door 18 oscillates down to be in the closed door state (FIG. 4). Operator OP inserts mask 15 from one end side (first end on the rear end side) of mask guide 15L (a mask inserting process along arrow P in FIGS. 6, 12A, and 13A), front cross frame 15*a* of mask frame 15F abuts on mask stopper 51 from the rear side, and mask 15 is positioned at mask standby position P1. Since operator OP positions mask 15 at mask standby position P1, rear door 18 oscillates down so as to be in the closed door state.

Since mask 15 is positioned at mask standby position P1 and a light receiving state of the inspection light (reflected light) of mask detecting sensor 52 is switched from a non-receiving state to a light receiving state, control device 60 picks the timing thereof and determines that mask 15 is positioned at mask standby position P1. In addition, control device 60 detects a state in which rear door 18 is in the closed door state, through rear-door sensor 18*a*.

In a case where control device 60 detects a state in which mask 15 is positioned at mask standby position P1 and rear door 18 is in the closed door state, stopper pins 51R of mask stopper 51 are pulled up, and mask 15 can further move to the front side than mask standby position P1 (that is, to a side of printing-job performing position P2). Since it is possible to move mask 15 to printing-job performing position P2, control device 60 moves mask 15 positioned at mask standby position P1 to printing-job performing position P2 (a mask moving process).

Figure 12B:
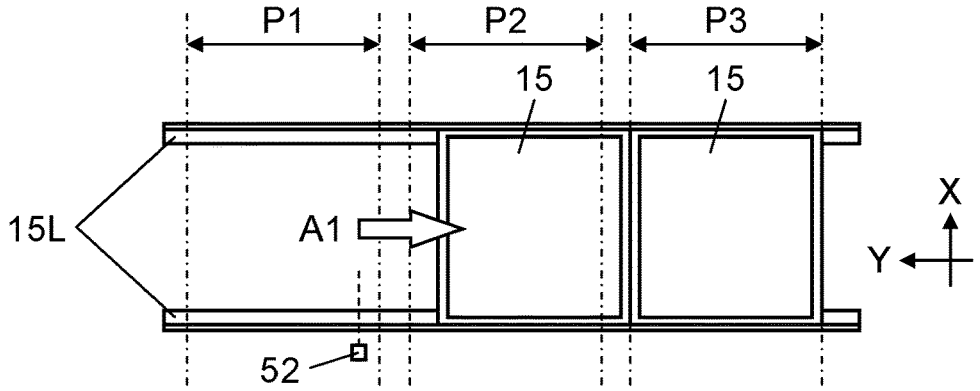
FIG. 12B is a partial plan view illustrating the procedure of mounting the mask by the screen printing apparatus in the exemplary embodiment.
Figure 13B:
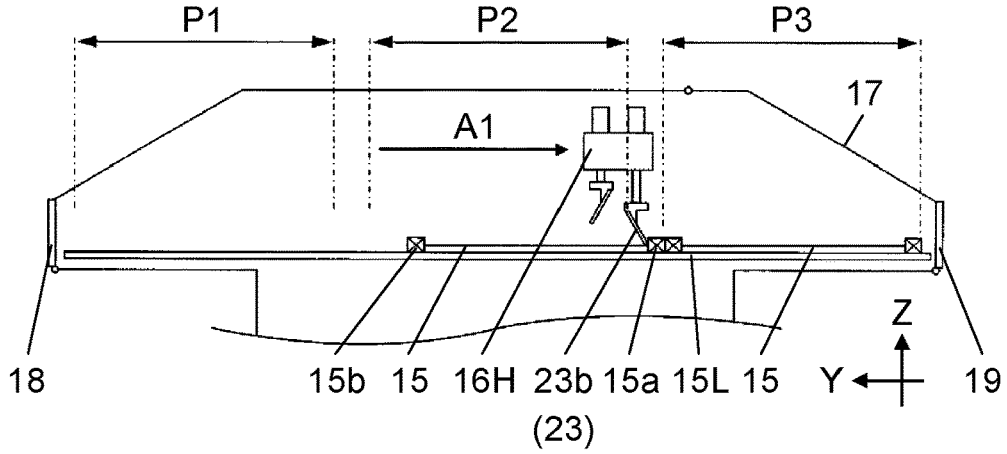
FIG. 13B is a partial side view illustrating the procedure of mounting the mask by the screen printing apparatus in the exemplary embodiment.

In the mask moving process, control device 60 pushes front cross frame 15*a* of mask 15 positioned at mask standby position P1 to the front side (arrow A1 in FIGS. 12B and 13B) by second squeegee 23*b*. In addition, in a case where mask 15 (used mask 15) is already positioned at printing-job performing position P2, the control device causes the used mask 15 to be also pushed together and causes the used mask 15 to be positioned at mask shelter position P3 (FIGS. 12B and 13B).

In screen printing apparatus 1 in the exemplary embodiment, a position (mask standby position P1), at which mask 15 is inserted, a position (printing-job performing position P2), at which mask 15 is brought into contact with board 2 and screen printing job is performed, and a position (mask shelter position P3), at which mask 15 is moved to be discharged, are set adjacent to each other in this order. Mask 15 positioned at mask standby position P1 and mask 15 positioned at printing-job performing position P2 can be caused to slide at the same time through an operation at once by a moving mechanism (squeegeeing mechanism 16 in the exemplary embodiment), can cause mask 15 positioned at mask standby position P1 to be positioned at printing-job performing position P2, and can cause mask 15 positioned at printing-job performing position P2 to be positioned at mask shelter position P3.

Figure 12C:
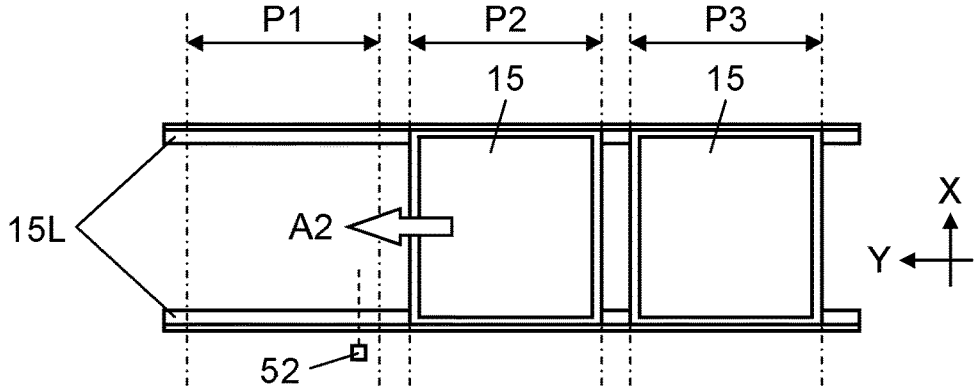
FIG. 12C is a partial plan view illustrating the procedure of mounting the mask by the screen printing apparatus in the exemplary embodiment.
Figure 13C:
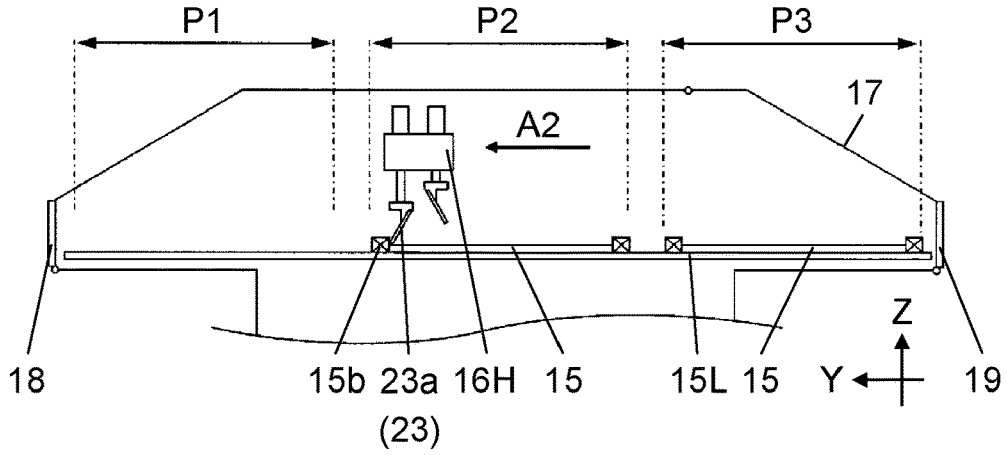
FIG. 13C is a partial side view illustrating the procedure of mounting the mask by the screen printing apparatus in the exemplary embodiment.

Since used mask 15 is positioned at mask shelter position P3, mask 15 that is to be mounted at printing-job performing position P2 is caused to slightly return to the rear side (arrow A2 in FIGS. 12C and 13C) by first squeegee 23*a*, and positioning is accurately performed (FIGS. 12C and 13C). As will be described below, in a state in which used mask 15 is moved to mask shelter position P3, operator OP causes front door 19 to be in the open door state, and then it is possible to pick up used mask 15 from the front end side (second end, that is, the other end side) of mask guide 15L.

Figure 14A:
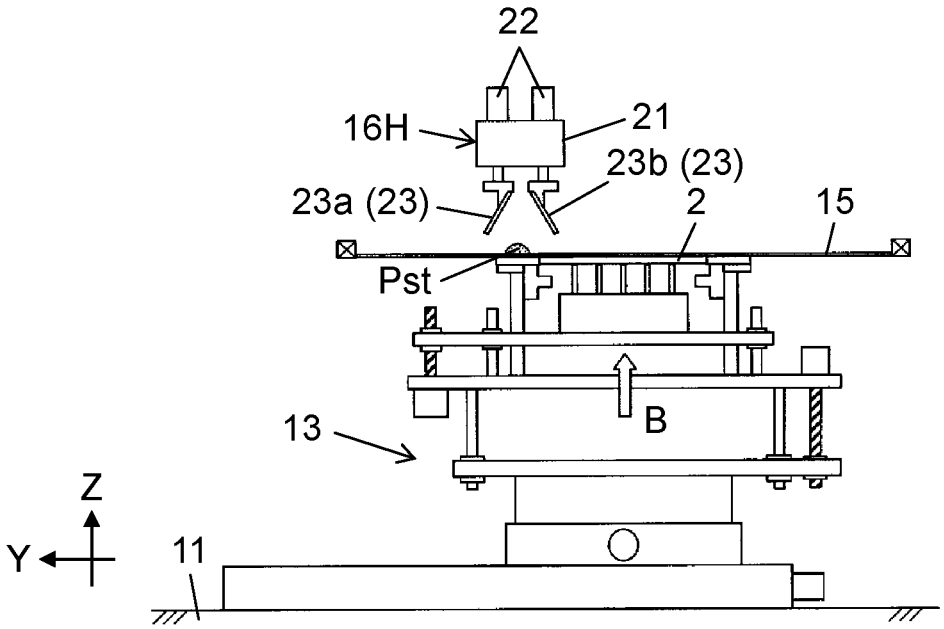
FIG. 14A is a partial side view illustrating an operation of the screen printing apparatus in the exemplary embodiment.
Figure 14B:
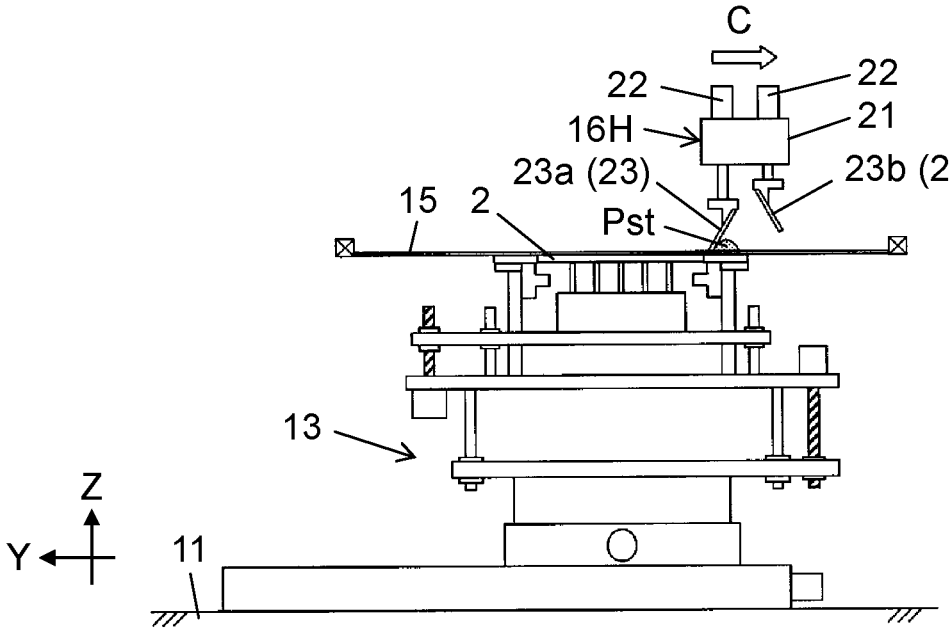
FIG. 14B is a partial side view illustrating the operation of the screen printing apparatus in the exemplary embodiment.
Figure 15A:
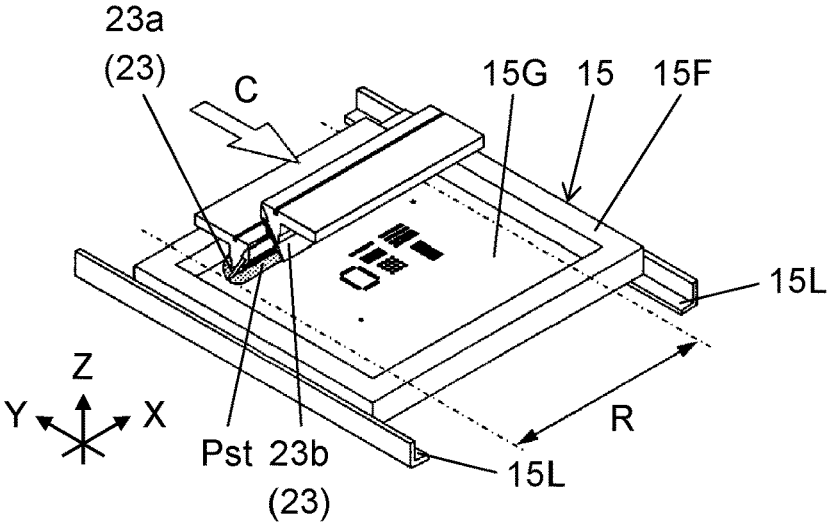
FIG. 15A is a partial perspective view illustrating the operation of the screen printing apparatus in the exemplary embodiment.
Figure 15B:
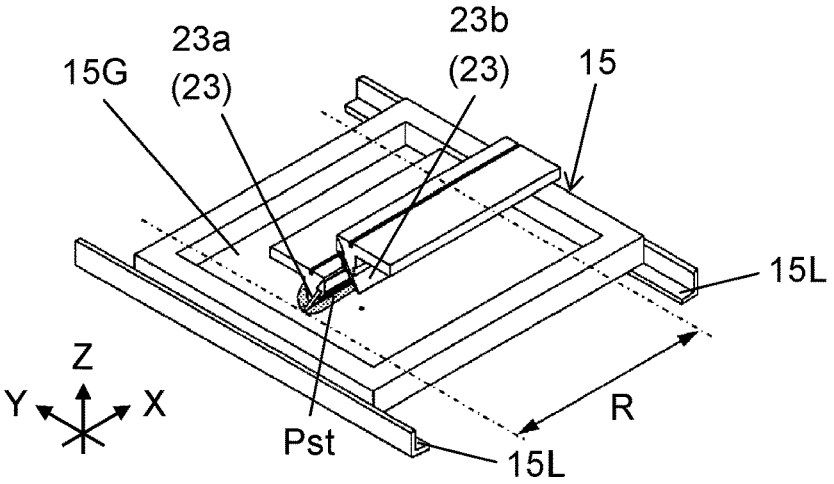
FIG. 15B is a partial perspective view illustrating the operation of the screen printing apparatus in the exemplary embodiment.
Figure 15C:
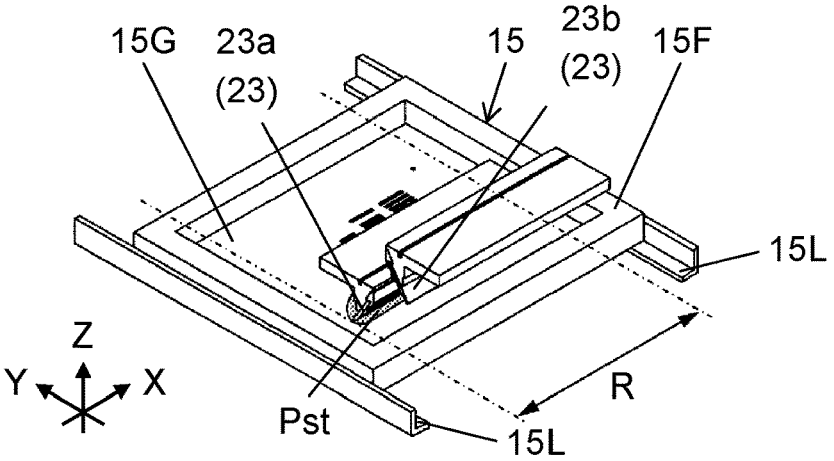
FIG. 15C is a partial perspective view illustrating the operation of the screen printing apparatus in the exemplary embodiment.

When screen printing apparatus 1 performs the screen printing job, the lower surface of mask 15 mounted at printing-job performing position P2 as described above approaches board 2 to the extent that the lower surface is almost in contact with the board (arrow B in FIG. 14A), then squeegee 23 is lowered to abut on mask 15 by squeegee lifting/lowering cylinder 22, and print head 1611 is horizontally (Y-axis direction) moved (arrow C in FIGS. 14B and 15A). In this manner, squeegee 23 slides on mask main body 15G, paste Pst is scraped on mask main body 15G (FIG. 15A→FIG. 15B→FIG. 15C), and paste Pst is applied on electrode 2*d* of board 2 via pattern openings 1511. Since paste Pst is applied on electrode 2*d* of board 2, board 2 is lowered to be separated from mask 15 (plate releasing) and unloading conveyor 14 unloads board 2 to a side of the downstream process.

Here, in a case where a mounting operation of mask 15 is performed, and mask 15 is already mounted at printing-job performing position P2, it is necessary to perform an operation of moving mask 15 (used mask 15) mounted at printing-job performing position P2 from printing-job performing position P2 as well as the mask mounting operation. In this case, it is necessary to perform a replacement operation of mask 15.

In the replacement operation of mask 15, control device 60, as described above, performs, at the same time, the position of moving mask 15 positioned at mask standby position P1 to printing-job performing position P2 and an operation of moving mask 15 (used mask 15) positioned at printing-job performing position P2 to mask shelter position P3. In detail, through an operation of moving mask 15 positioned at mask standby position P1 to printing-job performing position P2, mask 15 positioned at printing-job performing position P2 is moved to mask shelter position P3 (FIGS. 12B and 13B). In this manner, since used mask 15 is moved to mask shelter position P3, operator OP causes front door 19 to be in the open door state, and then it is possible to pick up used mask 15 from the front end side (second end, that is, the other end side) of mask guide 15L. Since control device 60 causes squeegeeing mechanism 16 to move used mask 15 to mask shelter position P3, front-door locking mechanism 19*a* unlocks front door 19, and operator OP can open front door 19.

During the unlocking of front door 19, it is preferable that a process performed during the unlocking is displayed on touch panel 61 or the like. In a case where operator OP picks up mask 15 and front door 19 is closed, control device 60 locks the door. In addition, in a case where mask 15 is not positioned at mask shelter position P3 and front door 19 is opened, a monitor display is displayed on touch panel 61 or the like such that front door 19 is closed.

A screen printing method used in screen printing apparatus 1 in the exemplary embodiment includes: a mask inserting process, a mask moving process, and a squeegeeing process. In the mask inserting process, mask 15 is inserted from one end of mask guide 15L and is positioned at mask standby position P1. In the mask moving process, mask 15 positioned at mask standby position P1 is moved printing-job performing position P2. In the squeegeeing process, squeegee 23 is caused to slide on mask 15 positioned at printing-job performing position P2 such that paste Pst is applied on board 2 that is brought into contact with mask 15. When mask 15 positioned at mask standby position P1 is moved to printing-job performing position P2, mask 15 that is moved from mask standby position P1 to printing-job performing position P2 pushes used mask 15 positioned at printing-job performing position P2 such that used mask 15 is moved to mask shelter position P3, and it is possible to pick up used mask 15 from the other end side of mask guide 15L.

As described above, in the exemplary embodiment, through an operation of moving mask 15 positioned at mask standby position P1 to printing-job performing position P2, it is possible to move mask 15 positioned at printing-job performing position P2 to mask shelter position P3. This is because mask standby position P1, printing-job performing position P2, and mask shelter position P3 are set adjacent to each other in series in this order on mask guides 15L. Further, a moving path (region between mask standby position P1 and printing-job performing position P2) of mask 15, which is used when used mask 15 is picked up (sheltered from printing-job performing position P2) on mask guide 15L, is different from a moving path (region between printing-job performing position P2 and mask sheltered position P3) of mask 15, which is used when used mask 15 is mounted. Further, this is because the two moving paths are connected adjacent to each other in one straight line.

In addition, according to the exemplary embodiment, operator OP can insert mask 15 into mask standby position P1 without stopping the operating operation at printing-job performing position P2. When operator OP has enough time, it is possible to pick up used mask 15 from mask shelter position P3. In this manner, in a case where one operator OP operates a plurality of screen printing apparatuses 1, operation efficiencies are improved at every stage by operator OP.

Figure 16A:
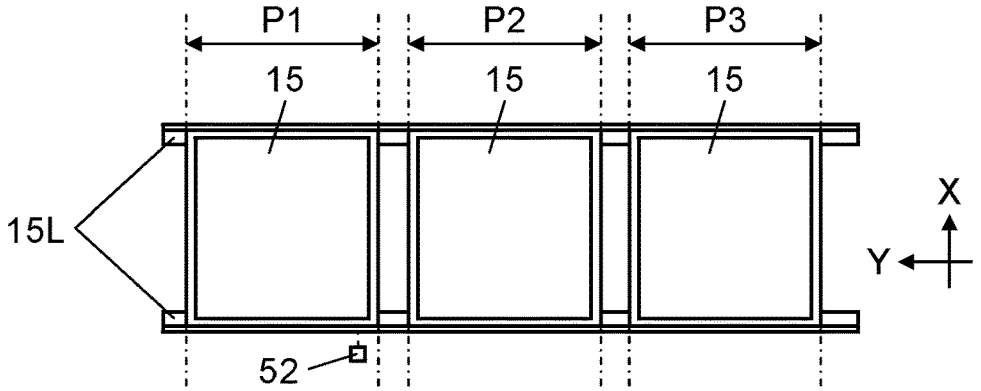
FIG. 16A is a partial plan view illustrating the procedure of mounting the mask by the screen printing apparatus in the exemplary embodiment.
Figure 16B:
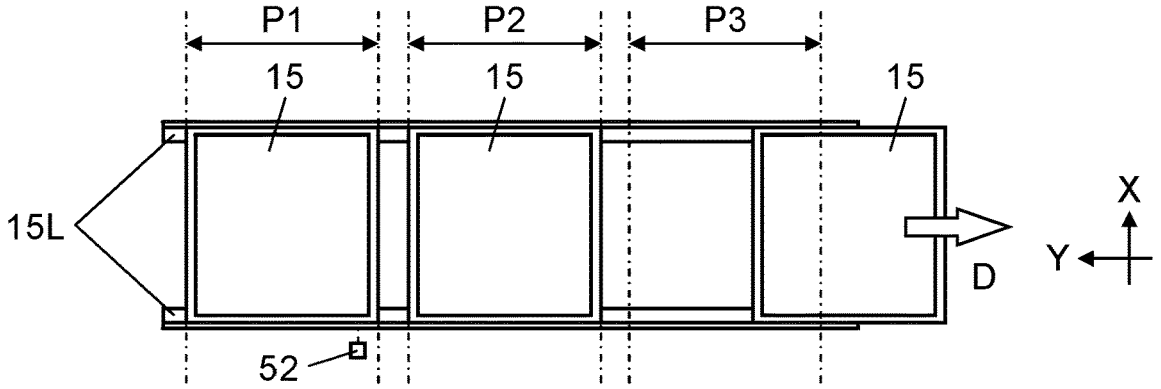
FIG. 16B is a partial plan view illustrating the procedure of mounting the mask by the screen printing apparatus in the exemplary embodiment.
Figure 16C:
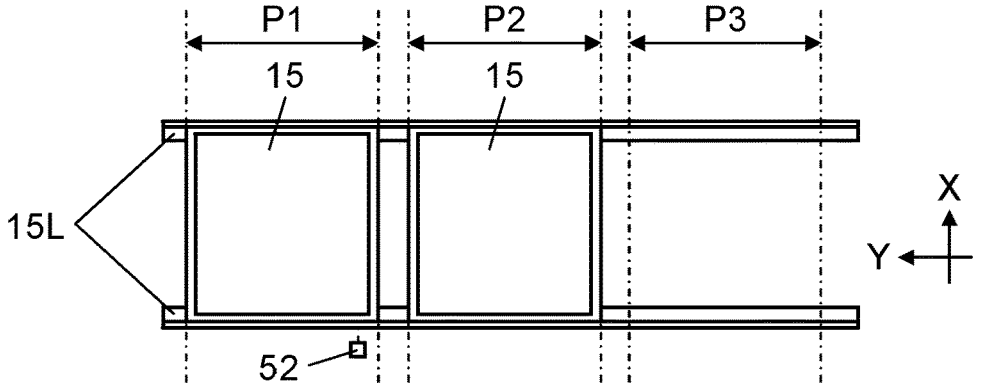
FIG. 16C is a partial plan view illustrating the procedure of mounting the mask by the screen printing apparatus in the exemplary embodiment.
Figure 17A:
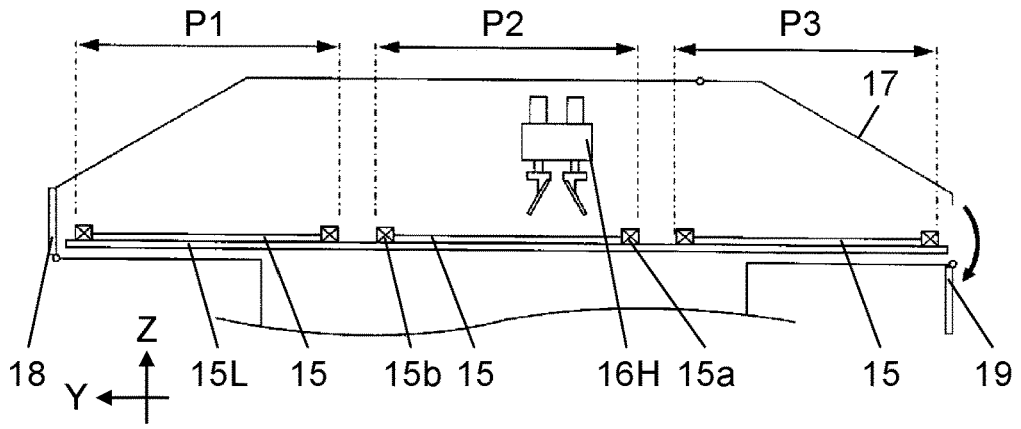
FIG. 17A is a partial side view illustrating the procedure of mounting the mask by the screen printing apparatus in the exemplary embodiment.
Figure 17B:
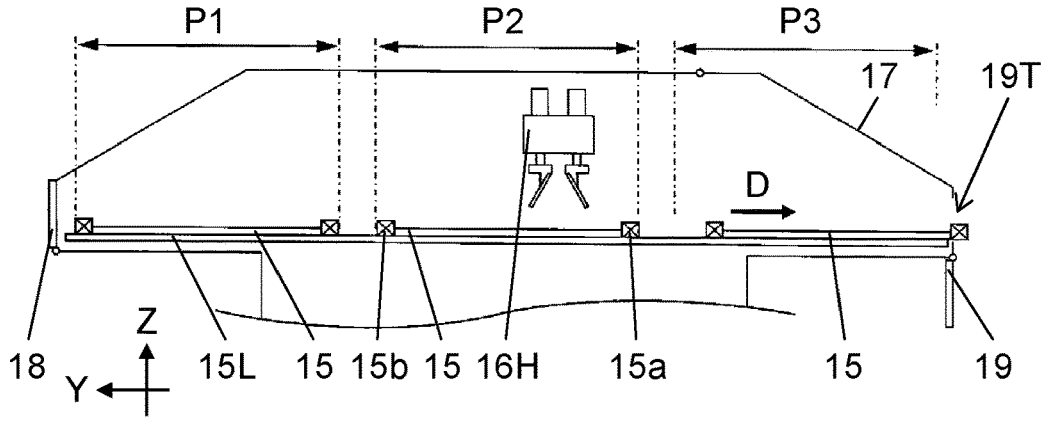
FIG. 17B is a partial side view illustrating the procedure of mounting the mask by the screen printing apparatus in the exemplary embodiment.
Figure 17C:
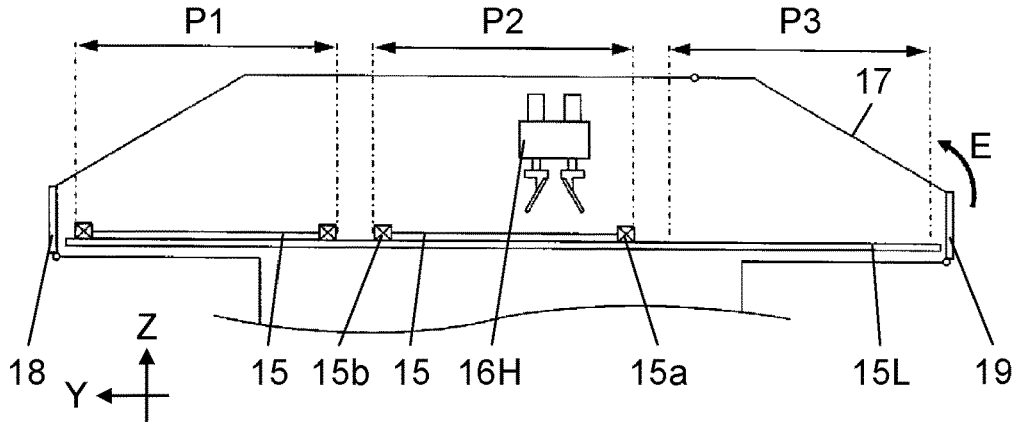
FIG. 17C is a partial side view illustrating the procedure of mounting the mask by the screen printing apparatus in the exemplary embodiment.

Before the mask mounting operation is performed, operator OP causes front door 19 to oscillate down so as to be in the open door state in a case where mask 15 is already positioned at mask shelter position P3 (FIGS. 16A and 17A), mask 15 positioned at mask shelter position P3 is picked up from mask picking-up opening 17T (arrow D in FIGS. 16B and 17B), and mask shelter position P3 is in an empty state (FIGS. 16C and 17C). Since front door 19 is closed (arrow E in FIG. 17C), the mounting operation of mask 15 is performed.

Figure 18A:
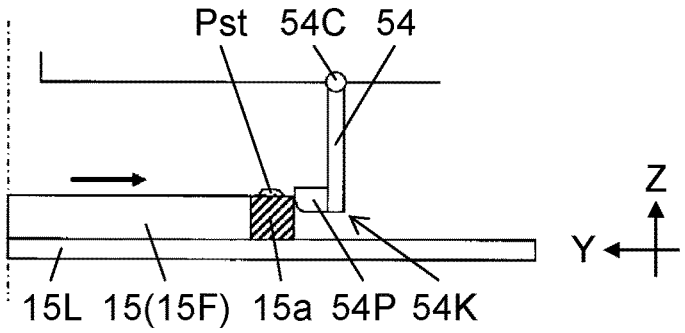
FIG. 18A is a partial side view illustrating the operation of the oscillating body provided in the screen printing apparatus in the exemplary embodiment.
Figure 18B:
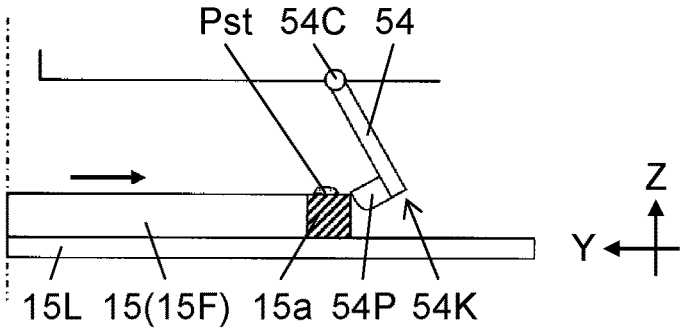
FIG. 18B is a partial side view illustrating the operation of the oscillating body provided in the screen printing apparatus in the exemplary embodiment.

In a case where used mask 15 positioned at printing-job performing position P2 is moved by squeegeeing mechanism 16 to mask shelter position P3, front cross frame 15*a* of used mask 15 pushes oscillating body 54 to the front side such that the oscillating body oscillates. At this time, front cross frame 15*a* of mask frame 15F does not directly abut on central portion 54T of oscillating body 54, but abuts on two protrusions 54P provided on the rear surface side of oscillating body 54 (FIG. 18A). When mask 15 moves onward to the front side in this state, front cross frame 15*a* of mask frame 15F pushes two protrusions 54P to the front side, and thus lower end 54K of oscillating body 54 is moved to the front side and oscillates (FIG. 18A—FIG. 18B and FIG. 10A). In other words, in the exemplary embodiment, two protrusions 54P brought into contact with mask frame 15F are pushed to the front side, and thereby oscillating body 54 is in the oscillating posture.

Figure 18C:
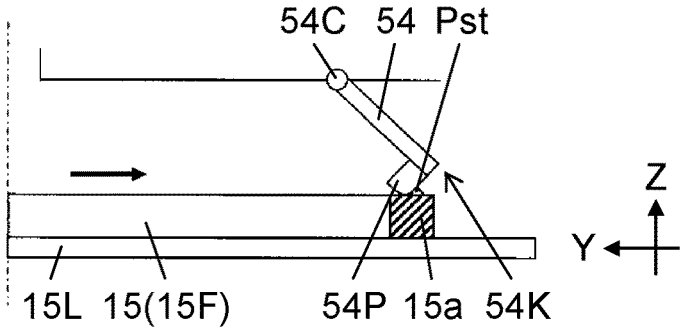
FIG. 18C is a partial side view illustrating the operation of the oscillating body provided in the screen printing apparatus in the exemplary embodiment.

While front cross frame 15*a* passes below protrusions 54P, oscillating body 54 maintains the oscillating posture when protrusions 54P are in contact with the top surface of front cross frame 15*a* (FIG. 18B→FIG. 18C). During the contact therebetween, oscillating body 54 comes into contact with only mask frame 15F at two protrusions 54P, and lower end 54K of central portion 54T of oscillating body 54 does not come into contact with mask frame 15F.

Figure 18D:
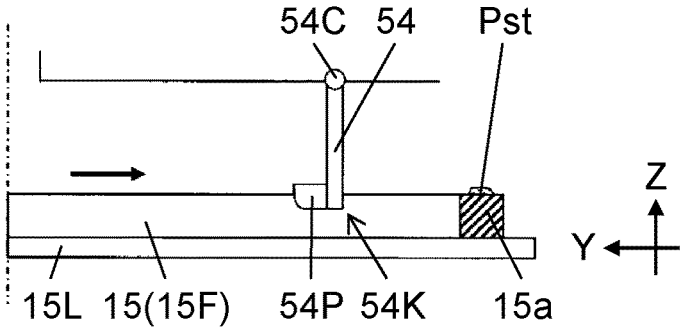
FIG. 18D is a partial side view illustrating the operation of the oscillating body provided in the screen printing apparatus in the exemplary embodiment.
Figure 19:
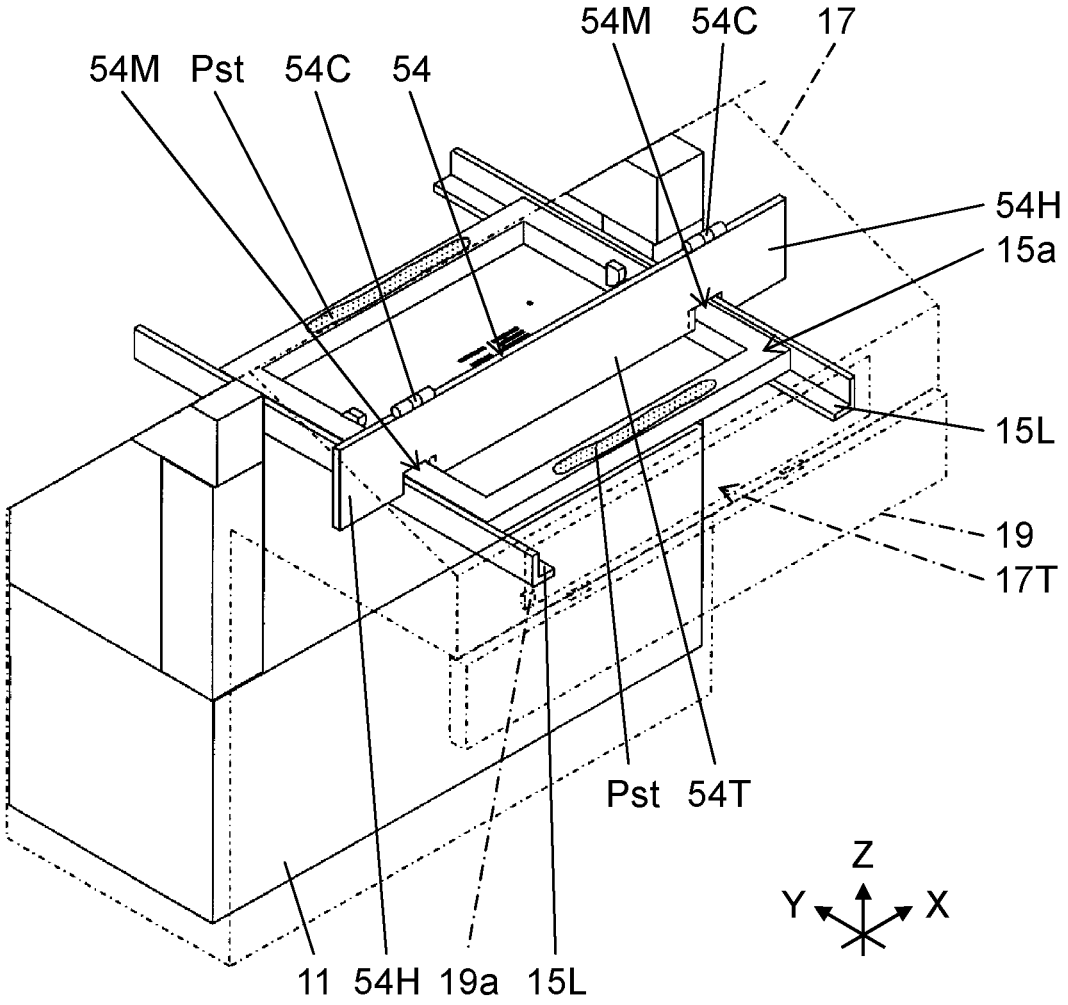
FIG. 19 is an enlarged perspective view of a front part of the screen printing apparatus in the exemplary embodiment.

When front cross frame 15*a* passes below oscillating body 54 and front cross frame 15*a* is separated from two protrusions 54P, oscillating body 54 does not receive the pushing force from front cross frame 15*a* of mask frame 15F, and thus the oscillating body returns to the drooping-down posture due to the own weight (FIGS. 18D and 10B). In a state in which mask 15 is positioned at mask shelter position P3, oscillating body 54 is in the drooping-down posture between front cross frame 15*a* and rear cross frame 15*b* of mask 15, and thus mask picking-up opening 17T is in a closed state (FIG. 19).

When operator OP picks up mask 15 positioned at mask shelter position P3 from mask picking-up opening 17T, rear cross frame 15*b* of mask 15 abuts on two protrusions 54P of oscillating body 54 from the rear side. Two protrusions 54P are pushed to the front side in response to movement of mask 15 to the front side, and lower end 54K of oscillating body 54 is moved to the front side so as to be in the oscillating posture.

While rear cross frame 15*b* passes below protrusions 54P, oscillating body 54 maintains the oscillating posture when protrusions 54P are in contact with the top surface of rear cross frame 15*b*. During the contact therebetween, oscillating body 54 comes into contact with only mask frame 15F at two protrusions 54P, and lower end 54K of central portion 54T of oscillating body 54 does not come into contact with mask frame 15F.

Figure 7:
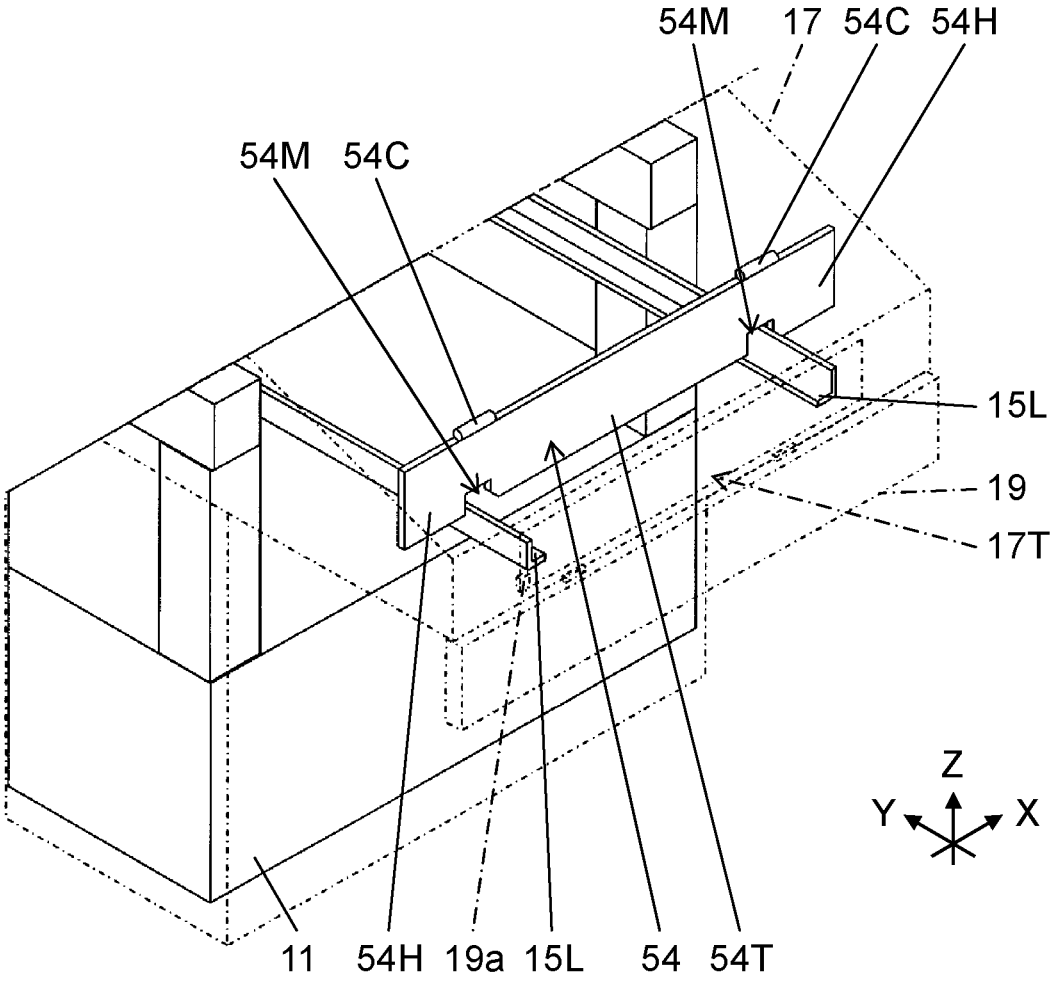
FIG. 7 is an enlarged perspective view of a front part of the screen printing apparatus in the exemplary embodiment.

When rear cross frame 15*b* passes below oscillating body 54, and rear cross frame 15*b* is separated from protrusions 54P, the oscillating body 54 returns to the drooping-down posture due to the own weight. In a state in which mask 15 is taken out from mask picking-up opening 17T, oscillating body 54 has a drooping-down posture and is in a closed state in which mask picking-up opening 17T is in a closed state (FIG. 7).

As described above, in the exemplary embodiment described above, when used mask 15 positioned at printing-job performing position P2 is moved to mask shelter position P3, oscillating body 54 is pushed and oscillates by the cross frame (front cross frame 15*a* or rear cross frame 15*b*) of mask frame 15F of used mask 15. After the cross frame passes immediately below oscillating body 54, the pushing force by the cross frame is canceled, the oscillating body returns to the drooping-down posture, and blocks mask picking-up opening 17T. In a state in which oscillating body 54 blocks mask picking-up opening 17T, it is not possible for operator OP to easily insert his or her hand to the inside of screen printing apparatus 1 through mask picking-up opening 17T. Therefore, oscillating body 54 becomes a safety securing unit that secures safety of operator OP.

In addition, in the exemplary embodiment, oscillating body 54 is provided with protrusions 54P protruding toward a side of printing-job performing position P2, and cross frame (front cross frame 15*a* or rear cross frame 15*b*) of used mask 15 that is moved from printing-job performing position P2 to mask shelter position P3 abuts on protrusions 54P. In this manner, lower end 54K of oscillating body 54 can oscillate without being brought into contact with cross frame of mask frame 15F. Therefore, even in a case where paste Pst drooping from squeegee 23 is attached to the top surface of the cross frame (refer to paste Pst in FIGS. 10A and 10B), paste Pst is not attached to lower end 54K of oscillating body 54.

If paste Pst is attached to lower end 54K of oscillating body 54, paste Pst is dispersed inside screen printing apparatus 1 depending on the oscillating operation of oscillating body 54. Dispersed paste Pst contaminates board 2 before and after the printing as well as internal mechanisms of screen printing apparatus 1. Since a great deal of time is taken for an operation of removing dispersed paste Pst, a significant effect is achieved by a configuration in which paste Pst is not attached to lower end 54K of oscillating body 54 as in the exemplary embodiment.

In screen printing apparatus 1 in such an exemplary embodiment, while oscillating body 54 prevents paste Pst from being dispersed by the attachment of paste Pst, operator OP is prevented from inserting a hand by mistake inside screen printing apparatus 1 from mask picking-up opening 17T.

A width of squeegee 23 (a size in the X-axis direction as size R illustrated in FIGS. 15A, 15B, and 15C) is smaller than an interval between two perpendicular frames 15*c* of mask frame 15F. Therefore, a region in the X-axis direction in which paste Pst drooping from squeegee 23 is attached on the top surface of cross frame of mask frame 15F is limited to a region between two grooves 54M. Therefore, as illustrated in the exemplary embodiment, if two protrusions 54P are provided at a position of an end portion of central portion 54T in the X-axis direction, on the rear surface side of oscillating body 54, two protrusions 54P are not brought into contact with paste Pst attached on the top surface of the cross frame, and paste Pst is not attached to any position of oscillating body 54 either.

As described above, an area in which paste Pst is dropped to mask frame 15F is limited to a position at which mask 15 passes through an area in which squeegee 23 moves. Since it is possible to specify an area on mask frame 15F in which paste Pst is dropped, protrusion 54P may be formed such that lower end 54K of oscillating body 54 does not come into contact with an area of mask frame 15F in which paste Pst can be dropped. Therefore, the forming positions of protrusions 54P may not be the positions illustrated in FIGS. 10A and 10B.

As described above, screen printing apparatus 1 in the exemplary embodiment includes mask guides 15L that is provided in the horizontal direction (Y-axial direction) and is provided with mask standby position P1, printing-job performing position P2, and mask shelter position P3 in this order from the one end side (first end), and squeegeeing mechanism 16 as a mask moving mechanism that moves mask 15 inserted from one end side of mask guide 15L and positioned at mask standby position P1 to printing-job performing position P2. Squeegeeing mechanism 16 as the mask moving mechanism moves used mask 15 positioned at printing-job performing position P2 to mask shelter position P3, and thereby it is possible to pick up and collect used mask 15 from the other end side (second end) of mask guides 15L. Therefore, it is possible for operator OP to manually collect used mask 15 and supply mask 15 that is used from here on. As a result, it is possible to achieve a configuration at low costs, compared to the screen printing apparatus including an automatic replacement function of masks in the related art. In addition, since there is no need to provide a stocker unlike the screen printing apparatus in the related art, an advantage is achieved in space.

In addition, in screen printing apparatus 1 in the exemplary embodiment, the moving path of mask 15 for picking up (sheltering) used mask 15 from printing-job performing position P2 is different from the moving path of mask 15 for mounting used mask 15 at printing-job performing position P2. Moreover, the two moving paths are connected adjacent to each other on a straight line. Therefore, during the replacement of masks 15, there is no need to perform two stages of operations of, first, picking up used mask 15 and then mounting mask 15 that is used from here on, and thus it is possible to perform the operation of picking up used mask 15 and the operation of mounting mask 15 that is to be used, at the same time (in the same operation). In other words, it is possible to rapidly replace the masks 15.

In addition, operator OP can insert mask 15 into mask standby position P1 in advance without stopping the operating operation at printing-job performing position P2. Therefore, when operator OP has sufficient time, it is possible to pick up used mask 15 from mask shelter position P3, and thus the operation efficiency by operator OP is improved at every stage in a case where one operator OP operates a plurality of screen printing apparatus 1.

In the exemplary embodiment, the squeegeeing mechanism and the mask moving mechanism are integrally formed; however, the squeegeeing mechanism and the mask moving mechanism may be individually configured.

In short, in the exemplary embodiment, mask 15 is moved by first squeegee 23*a* and second squeegee 23*b*. First squeegee 23*a* and second squeegee 23*b* are used as the mask moving mechanism. In addition, each of first squeegee 23*a* and second squeegee 23*b* has the squeegeeing mechanism. The squeegeeing mechanism and the mask moving mechanism are integrally formed, and squeegee 23 serves as the squeegeeing mechanism and the mask moving mechanism. However, an element having the squeegeeing mechanism and an element having the mask moving mechanism may be constructed separately. In this case, the element moves mask 15 by the mask moving mechanism is not necessarily a squeegee.

The screen printing apparatus and the screen printing method in which it is possible to rapidly perform automatic replacement of masks in a configuration achieved at low costs are provided.

What is claimed is:

1. A screen printing apparatus comprising:

a mask guide that is provided with a mask standby position, a printing-job performing position, and a mask shelter position in this order from a first end to a second end of the mask guide; and a mask moving mechanism being configured to move a mask inserted from the first end of the mask guide and positioned at the mask standby position to the printing-job performing position;

the mask moving mechanism having a first squeegee and being configured to cause the first squeegee to slide on the mask when positioned at the printing-job performing position such that paste is applied on a board under the mask, thereby resulting in the mask being a used mask, the mask moving mechanism being configured to move the used mask positioned at the printing-job performing position to the mask shelter position such that it is possible to pick up the used mask from the second end of the mask guide, and the mask moving mechanism being configured to cause the first squeegee and/or a second squeegee of the mask moving mechanism to move the mask.

2. The screen printing apparatus of claim 1, wherein the mask moving mechanism is configured to push the used mask positioned at the printing-job performing position to the mask shelter position by another mask moved from the mask standby position to the printing-job performing position.

3. The screen printing apparatus of claim 2, wherein the mask moving mechanism includes the second squeegee, and wherein the mask moving mechanism is configured to cause the second squeegee to move the another mask to thereby push the used mask positioned at the printing-job performing position to the mask shelter position.

4. The screen printing apparatus of claim 3, wherein the mask moving mechanism is configured to cause the second squeegee to engage a paste application surface of the mask to thereby move both the another mask and the used mask.

5. The screen printing apparatus of claim 2, wherein the first squeegee is configured to move the another mask that pushes the used mask to the mask shelter position to the printing-job performing position.

6. The screen printing apparatus of claim 2, further comprising:

an oscillating body that sags down in the vicinity of the second end in a state in which an upper edge of the oscillating body is hinged, wherein the mask has a rectangular mask frame formed of a pair of cross frames and a pair of perpendicular frames, wherein the oscillating body is configured to oscillate by being pushed by the cross frames of the mask frame of the used mask when the used mask positioned at the printing-job performing position is moved to the mask shelter position, such that the cross frames pass immediately below the oscillating body, and wherein the oscillating body further is configured to return to a sagging-down position upon the push by the cross frames being removed.

7. The screen printing apparatus of claim 6, wherein the oscillating body is provided with a protrusion that protrudes to a side of the printing-job performing position, and the cross frames of the mask frame of the used mask moved from the printing-job performing position to the mask shelter position abut on the protrusion, and a lower end of the oscillating body oscillates without coming into contact with the cross frames.

8. The screen printing apparatus of claim 1, further comprising:

a cover member that is provided to cover the mask guide, and is provided with a mask inserting opening that is open on a side of the mask standby position of the mask guide, and a mask picking-up opening that is open on a side of the mask shelter position of the mask guide.

9. The screen printing apparatus of claim 1, further comprising:

an oscillating body that sags down in the vicinity of the second end in a state in which an upper edge of the oscillating body is hinged, wherein the mask, and the mask thereafter being the used mask, has a rectangular mask frame formed of a pair of cross frames and a pair of perpendicular frames, wherein the oscillating body is configured to oscillate by being pushed by the cross frames of the mask frame of the used mask when the used mask positioned at the printing-job performing position is moved to the mask shelter position, such that the cross frames pass immediately below the oscillating body, and wherein the oscillating body further is configured to return to a sagging-down position upon the push by the cross frames being removed.

10. The screen printing apparatus of claim 9, wherein the oscillating body is provided with a protrusion that protrudes to a side of the printing-job performing position, and the cross frames of the mask frame of the used mask moved from the printing-job performing position to the mask shelter position abut on the protrusion, and a lower end of the oscillating body oscillates without coming into contact with the cross frames.

11. The screen printing apparatus of claim 1, wherein the mask moving mechanism is configured to cause the first squeegee to move the mask.

12. The screen printing apparatus of claim 1, wherein the mask moving mechanism is configured to cause the first squeegee to move the mask in a direction of the mask standby position.

13. The screen printing apparatus of claim 1, wherein the mask moving mechanism is configured to cause the first squeegee to engage the paste application surface of the mask to thereby move the mask.

14. A screen printing method comprising:

inserting a mask from a first end of a mask guide, which is provided in a horizontal direction and is provided with a mask standby position, a printing-job performing position, and a mask shelter position in this order from the first end to a second end, to be positioned the mask at the mask standby position;

moving the mask positioned at the mask standby position to the printing-job performing position;

performing squeegeeing by causing a first squeegee to slide on the mask positioned at the printing-job performing position such that paste is applied on a board under the mask, resulting in the mask being a used mask;

moving the used mask positioned at the printing-job performing position to the mask shelter position via one of the first squeegee or another a second squeegee of a mask moving mechanism; and picking up the used mask from the second end of the mask guide.

15. The screen printing method of claim 14, wherein, the mask moving mechanism is configured to move another mask positioned at the mask standby position to the printing-job performing position and to push the used mask positioned at the printing-job performing position to the mask shelter position with the another mask that is moved from the mask standby position to the printing-job performing position.

16. A screen printing apparatus comprising:

a mask guide that is provided with a mask standby position, a printing-job performing position, and a mask shelter position in this order from a first end to a second end of the mask guide; and a mask moving mechanism being configured to move a mask, inserted from the first end of the mask guide and positioned at the mask standby position, to the printing-job performing position; and the mask moving mechanism having a first squeegee and being configured to cause the first squeegee to slide on the mask positioned at the printing-job performing position such that paste is applied on a board under the mask, the mask moving mechanism being configured to move the used mask positioned at the printing-job performing position to the mask shelter position such that it is possible to pick up the used mask from the second end of the mask guide, and the mask moving mechanism having a second squeegee and being configured to cause the at least one of the first squeegee and the second squeegee to engage a paste application surface of the mask to thereby move the mask.

17. The screen printing apparatus of claim 16, wherein the mask moving mechanism is configured to cause each of the first and second squeegees to engage the paste application surface to thereby move the mask along the mask guide.

* * * * *